US012180709B2

(12) United States Patent
Magin et al.

(10) Patent No.: US 12,180,709 B2
(45) Date of Patent: Dec. 31, 2024

(54) ADJUSTABLE CEILING PANEL, METHOD OF MANUFACTURE, AND CEILING PANEL SYSTEM

(71) Applicant: CertainTeed Ceilings Corporation, Malvern, PA (US)

(72) Inventors: Michael Magin, Norcross, GA (US); David A. Bailey, Norcross, GA (US); Christopher G. Jones, Norcross, GA (US); Michael J. Lembo, Malvern, PA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 0 days.

(21) Appl. No.: 17/320,651

(22) Filed: May 14, 2021

(65) Prior Publication Data

US 2021/0355680 A1 Nov. 18, 2021

Related U.S. Application Data

(60) Provisional application No. 63/025,050, filed on May 14, 2020.

(51) Int. Cl.
*E04B 9/00* (2006.01)
*E04B 9/04* (2006.01)
(Continued)

(52) U.S. Cl.
CPC ..... *E04B 9/003* (2013.01); *E04B 9/0407* (2013.01); *E04B 9/225* (2013.01); *E04B 9/363* (2013.01); *E04B 9/366* (2013.01); *E04B 9/068* (2013.01)

(58) Field of Classification Search
CPC ..... E04B 1/8209; E04B 1/8227; E04B 1/994; E04B 2001/8263; E04B 2001/829;
(Continued)

(56) References Cited

U.S. PATENT DOCUMENTS 3,221,835 A * 12/1965 Wenger ..... E04B 1/994 135/21
3,310,924 A 3/1967 Boynton
(Continued)

FOREIGN PATENT DOCUMENTS

CA 2866575 A1 9/2013
CN 209837434 U 12/2019
(Continued)

OTHER PUBLICATIONS

Copending U.S. Appl. No. 29/757,552, filed Nov. 6, 2020.
(Continued)

*Primary Examiner* — Kyle J. Walraed-Sullivan
(74) *Attorney, Agent, or Firm* — McDonnell Boehnen Hulbert & Berghoff LLP

(57) ABSTRACT

The present disclosure relates generally to ceiling panels, for example, suitable for use forming a ceiling surface. The present disclosure relates more particularly to a ceiling panel including a panel body and a bracket. The panel body includes an upper surface, a lower surface, a first end, a second end, a first lateral side, and a second lateral side. The bracket extends upward from the upper surface of the panel body and is offset from a center of gravity of the panel body toward the first end. The bracket includes an upper fastener configured to attach the ceiling panel to a frame element of a ceiling grid. An angle of the panel body is adjustable with respect to the attachment of the upper fastener of the bracket.

20 Claims, 17 Drawing Sheets

(51) Int. Cl.
*E04B 9/22* (2006.01)
*E04B 9/36* (2006.01)
*E04B 9/06* (2006.01)

(58) Field of Classification Search
CPC .. E04B 2001/8414; E04B 9/001; E04B 9/003; E04B 9/0407; E04B 9/20; E04B 9/205
See application file for complete search history.

(56) References Cited

U.S. PATENT DOCUMENTS 3,590,354 A * 6/1971 Shiflet ..... E04B 1/994 318/245
3,599,921 A * 8/1971 Cumber ..... E04B 9/006 248/300
4,062,164 A * 12/1977 Cousins ..... E04B 9/247 52/506.07
4,261,433 A 4/1981 Propst
4,441,282 A 4/1984 Thual
6,318,671 B1 * 11/2001 Schumacher ..... B64D 11/003 244/118.5
7,445,188 B2 * 11/2008 Lamparter ..... B60R 5/003 312/246
D589,633 S 3/2009 Mattingly
D651,325 S 12/2011 Martin
D651,728 S 1/2012 Martin
9,187,897 B1 * 11/2015 Bergman ..... E04B 9/26
2003/0205016 A1 11/2003 Gulbrandsen
2004/0244323 A1 12/2004 Ostenfeldt
2008/0190690 A1 * 8/2008 Waters ..... E04B 1/994 181/287
2014/0299407 A1 * 10/2014 Caimi ..... E04B 9/001 181/287
2014/0353079 A1 * 12/2014 Gimpel ..... E04B 1/86 181/290
2015/0240490 A1 * 8/2015 Firinga ..... E04B 9/12 52/506.05
2016/0053489 A1 * 2/2016 Porter ..... F16M 13/027 248/214
2016/0145860 A1 * 5/2016 Thiede ..... E04B 1/8236 29/433
2016/0333581 A1 11/2016 Van Dore
2018/0127976 A1 5/2018 Gillette
2018/0251978 A1 * 9/2018 Yaphe ..... E04B 9/18
2018/0283004 A1 10/2018 Gillette
2019/0017260 A1 1/2019 Bou Harb
2019/0292774 A1 * 9/2019 Durali ..... E04B 1/994

FOREIGN PATENT DOCUMENTS

CN 110965692 A 4/2020
CN 111075098 A * 4/2020 ..... E04B 9/065
JP H05-280134 A 10/1993

OTHER PUBLICATIONS

Copending U.S. Appl. No. 29/757,555, filed Nov. 6, 2020.
Copending U.S. Appl. No. 29/757,558, filed Nov. 6, 2020.
Copending U.S. Appl. No. 29/757,562, filed Nov. 6, 2020.
International Search Report and Written Opinion in PCT/US2021/032430, dated Sep. 3, 2021.

* cited by examiner

ADJUSTABLE CEILING PANEL, METHOD OF MANUFACTURE, AND CEILING PANEL SYSTEM

CROSS-REFERENCE TO RELATED APPLICATIONS

This application claims the benefit of priority of U.S. Provisional Patent Application No. 63/025,050, filed May 14, 2020, which is hereby incorporated herein by reference in its entirety.

BACKGROUND OF THE DISCLOSURE

1. Field of the Disclosure

The present disclosure relates generally to ceiling panels, for example, suitable for forming a ceiling surface to cover the functional or living space of a room. The present disclosure relates more particularly to an adjustable ceiling panel for attachment to a ceiling grid, a method of making such a ceiling panel and a ceiling system that includes such a ceiling panel.

2. Technical Background

Many ceiling systems have several different well-known configurations. One common system is in the form of a ceiling surface that is formed by ceiling tiles supported by a metal grid. The grid is suspended below a structural ceiling of a room to create a plenum, or air space, between the panels and the structural ceiling. The lower sides of the panels are viewed from below as a dropped ceiling of the room. A similar system uses larger panels, such as gypsum panels, that are attached to the grid and form a continuous ceiling surface below the plenum. Further, some systems include baffles that hang down vertically from either a grid or directly from the structural ceiling. Such baffles may be used, for example, for sound attenuation.

These common ceiling systems are both attractive and functional, but they provided limited design choice. Many of these ceiling systems vary only in their color or texture, and therefore provide a very familiar aesthetic. If an alternative design aesthetic is desired, the builder or architect may consider a custom ceiling installation the only available option.

Accordingly, the present inventors have determined that a ceiling system that provides an alternative configuration to common installations would be desirable to architects and builders.

SUMMARY OF THE DISCLOSURE

In one aspect, the present disclosure provides a ceiling panel comprising:

a panel body including an upper surface, a lower surface, a first end, a second end, a first lateral side, and a second lateral side; and a bracket extending upward from the upper surface of the panel body and offset from a center of gravity of the panel body toward the first end, the bracket including an upper fastener configured to attach the ceiling panel to a frame element of a ceiling grid, wherein an angle of the panel body is adjustable with respect to the attachment of the upper fastener of the bracket.

In another aspect, the disclosure provides a method of making a ceiling panel according to the disclosure, the method comprising:

forming the panel body;

forming the fin of the lower fastener of the bracket on the upper surface of the panel body; and attaching the upper fastener of the bracket to the fin of the lower fastener of the bracket.

In another aspect, the disclosure provides a ceiling system comprising:

a ceiling grid formed by a plurality of frame elements including a first frame element;

a first ceiling panel according to the disclosure attached to the first frame element; and a second ceiling panel according to the disclosure attached to the first frame element.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional ceiling panel systems have limited variation in their design. The present inventors have determined that a ceiling system that provides an alternative configuration to common installations would be desirable to architects and builders.

Accordingly, one aspect of the disclosure is a ceiling panel including a panel body and a bracket configured to attach the ceiling panel to a frame element of a ceiling grid. The panel body includes an upper surface, a lower surface, a first end, a second end, a first lateral side, and a second lateral side. The bracket extends upward from the upper surface of the panel body and is offset from a center of gravity of the panel body toward the first end. The bracket including an upper fastener configured to attach the frame element. Further, an angle of the panel body is adjustable with respect to the attachment of the upper fastener of the bracket.

The description of the bracket as being laterally offset from the center of gravity of the panel body, as set forth herein, means that the center of the bracket is offset from the center of gravity of the panel body. For example, in some embodiments, the entire bracket is disposed at a distance from the center of gravity of the panel body. In other embodiments, a portion of the bracket overlaps with the center of gravity of the panel body, but the center of the bracket is spaced from the center of gravity of the panel body. For example, in some embodiments, the center of the bracket is substantially spaced from the center of gravity of the panel body, such as a separation of at least one inch.

Figure 1:
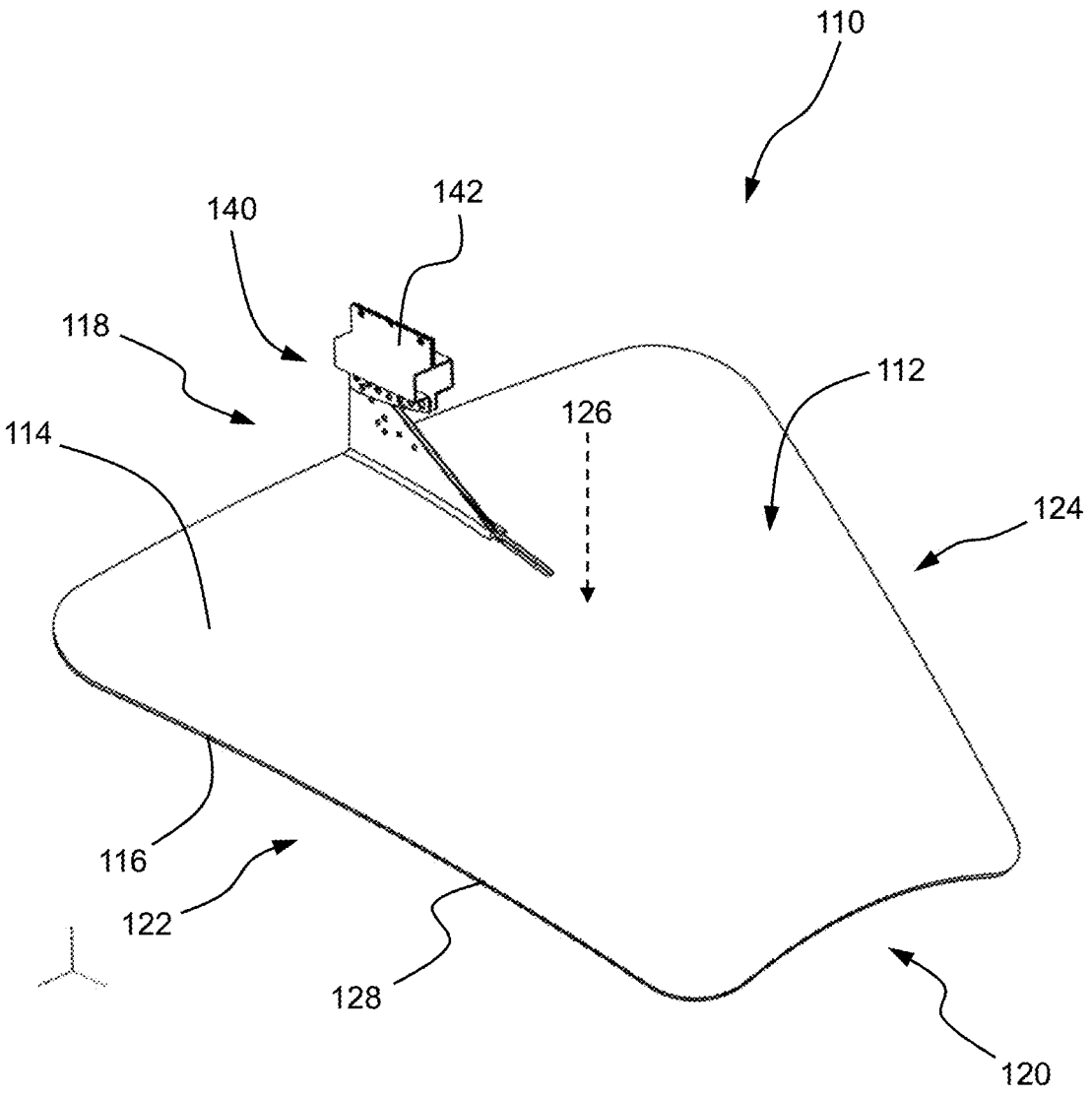
FIG. 1 is a schematic perspective view of a ceiling panel according to an embodiment of the disclosure.

Such a ceiling panel is shown perspective view in FIG. 1. Ceiling panel 110 includes a panel body 112 and a bracket 140 that is secured to the panel body 112 and configured to attach the ceiling panel 110 to a frame element (see FIG. 4). Panel body 112 is in the form of a sheet and has a length and a width that are both substantially larger than the thickness of the panel body 112. Further, panel body 112 has an upper surface 114 and a lower surface 116 that is opposite the upper surface 114. The panel body 112 extends from a first end 118 to a second end 120 along its length and from a first lateral side 122 to a second lateral side 124 across its width. The terms length, width, end, and lateral side, as used herein do not refer to a particular relative size of these dimensions. Thus, the length may be longer or shorter than the width. Instead, the ends and the lateral sides are characterized by their relation to the bracket 140. In particular, bracket 140 extends upward from the upper surface 114 of panel body 112 and is laterally offset from a center of gravity 126 of panel body 112 toward first end 118.

Bracket 140 includes an upper fastener 142 that is configured to attach to the frame element so as to secure the ceiling panel 110 to the frame element. Moreover, the orientation of ceiling panel 110 is variable so as to allow for different configurations of ceiling panel 110 with respect to the frame element. In particular, the angle of panel body 112 is adjustable with respect to the upper fastener 142 of bracket 140. Accordingly, bracket 140 may be attached to the frame element in a particular configuration while the angle of the panel body 112 can be adjusted to provide a particular design aesthetic.

In some embodiments, the angle of the panel body is adjustable about an axis extending in the lateral direction. The lateral direction, as described herein, refers to the direction in which the panel extends from the first lateral side to the second lateral side. In particular, as set forth herein, the panel body extends in a longitudinal direction from the first end to the second end and in a lateral direction from the first lateral side to the second lateral side. In some embodiments, the panel body is rotatable about an axis that runs in the lateral direction, such that the angle of the panel body is adjustable about the lateral direction.

The configuration of ceiling panel 110 provides several unique design features compared to typical ceiling panels. For example, the attachment of ceiling panel 110 using bracket 140 allows the panel body 112 to have a shape that is not configured by the shape of a ceiling grid that contains the frame element. Most ceiling grids are formed of perpendicular frame elements that form a rectangular grid. Typical ceiling panels are designed such that the outer edges of the panel rest on the frame elements. Accordingly, the panel body of most ceiling panels has a rectangular shape that matches the openings between frame elements of the corresponding ceiling grid. By using the bracket 140 of ceiling panel 110, the panel body 112 can have any of a variety of different shapes and is not limited by the shape of openings of the ceiling grid.

As another example, the attachment of ceiling panel 110 using bracket 140, which is offset from the center of gravity 126 of panel body 112, allows the ceiling panel 110 to overlap an adjacent ceiling panel having a similar configuration. Likewise, the panel body 112 can also be overlapped by another adjacent ceiling panel. For example, the second end 120 of panel body 112 can be positioned to lie beneath an adjacent ceiling panel positioned at the second end and the first end 118 of panel body 112 can be positioned to lie above another adjacent ceiling panel positioned at the first end. A system including such overlapping ceiling panels is described in more detail below.

Figure 2:
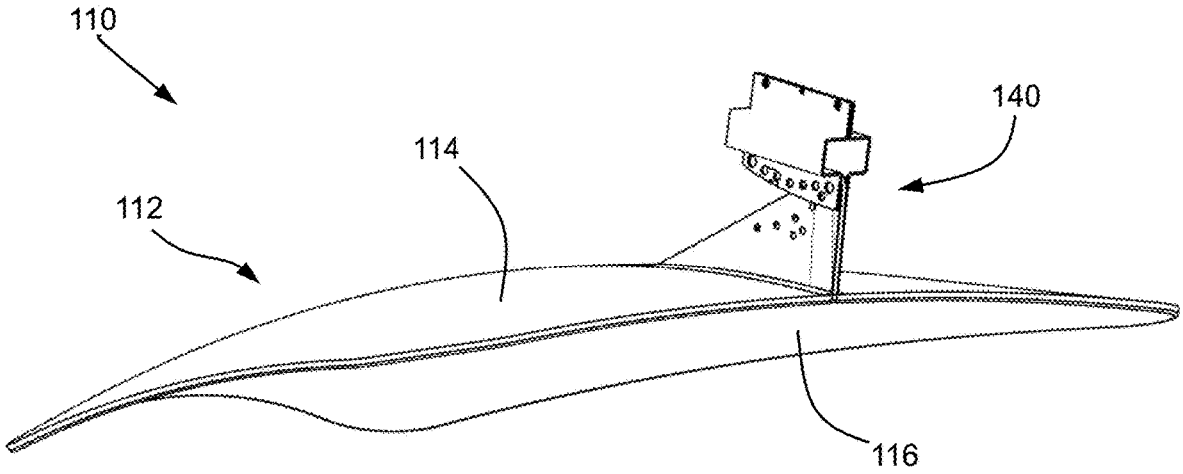
FIG. 2 is a schematic side angled view of the ceiling panel of FIG. 1.

In certain embodiments of the ceiling panel as otherwise described herein, the panel body is curved. For example, in some embodiments the upper and lower surfaces of the panel body are curved such that the panel body has the overall form of a curved surface. For example, as shown more clearly in the side view of FIG. 2, panel body 112 of ceiling panel 110 curves so as to have the shape of a portion of a dome. For example, in some embodiments, the panel body forms a bowl-like surface with a compound curve. In other words, in some embodiments, at any particular point on the panel body, the surface is arcuate in all directions. In other embodiments, only a section of the surface of the panel body includes a compound curve, while other sections curve in a single direction or are flat. Further, in some embodiments, the panel body is flat.

In certain embodiments of the ceiling panel as otherwise described herein, the lower surface of the panel body is concave. For example, as shown more clearly in FIG. 2, the lower surface 116 of panel body 112 is concave. Moreover, because the panel body 112 has the form of a sheet, or a shell, the upper surface 118 of the panel body 112 is convex. Accordingly, the outer perimeter of panel body 112 curves downward and away from bracket 140. In other embodiments, the thickness of the panel body varies, for example such that the panel body is thinnest toward the center where the concave lower surface has curved inward from the surrounding perimeter.

In certain embodiments of the ceiling panel as otherwise described herein, the lower surface of the panel body is convex. For example, in some embodiments, the panel body has the form of a sheet or shell and the lower surface is convex while the upper surface is concave. Accordingly, the outer perimeter of the panel body of such embodiments curves upward and around the bracket. Again, in other embodiments, the thickness of the panel body varies, for example such that the panel body is thickest toward the center where the convex lower surface has curved outward from the surrounding perimeter.

Still, in other embodiments, a curve of the lower surface of the panel body has at least one inflection point. For example, in some embodiments, the panel body has undulating upper and lower surfaces. Further still, in some embodiments the panel body is planar and neither the upper surface nor the lower surface is curved.

In certain embodiments of the ceiling panel as otherwise described herein, an outer edge of the panel body is rounded. For example, in some embodiments, the outer edge of the panel body is rounded in sections around the circumference of the panel body. Further, in some embodiments, the outer edge includes straight sections. Moreover, in some embodiments, the outer edge includes sharp corners. For example, in some embodiments, the panel body includes an outer edge that has both rounded and sharp corners. The term outer edge as used herein is the outermost edge of the panel body. In some embodiments, the outer edge of the panel body is the outermost extension of the ceiling panel. In ceiling panel 110, the panel body 112 includes an outer edge 128 that is rounded in sections around its periphery. These rounded sections are connected by substantially straight sections.

In certain embodiments of the ceiling panel as otherwise described herein, a width of the panel body tapers along a longitudinal direction extending from the first end to the second end. For example, the width of panel body 112 of ceiling panel 110 tapers inward from the first end 118 to the second end 120 such that the width of the panel body 112 is wider at the first end 118 than the second end 120. The tapered width of the panel body allows the panel bodies of neighboring ceiling panels to fit together more closely than panel bodies of other shapes. For example, adjacent tapered panel bodies that extend in opposing directions may be positioned at a similar height and overlap one another, whereas the outer edges of panel bodies of other shapes, such as rectangles, may prevent overlapping of adjacent panels. Further, the tapered width of the panel body also allows variation in the visibility of structures behind the panel body. For example, where a group of ceiling panels with tapered panel bodies are arranged so as to overlap one another, the inward taper allows the laterally outer portion of the covered ceiling panel to be viewed. In other words, where the narrower end of one ceiling panel covers the wider end of another ceiling panel, the lateral outer edges of the wider end of the covered ceiling panel will extend beyond the lateral outer edges of the narrower end of the foremost ceiling panel.

Figure 3:
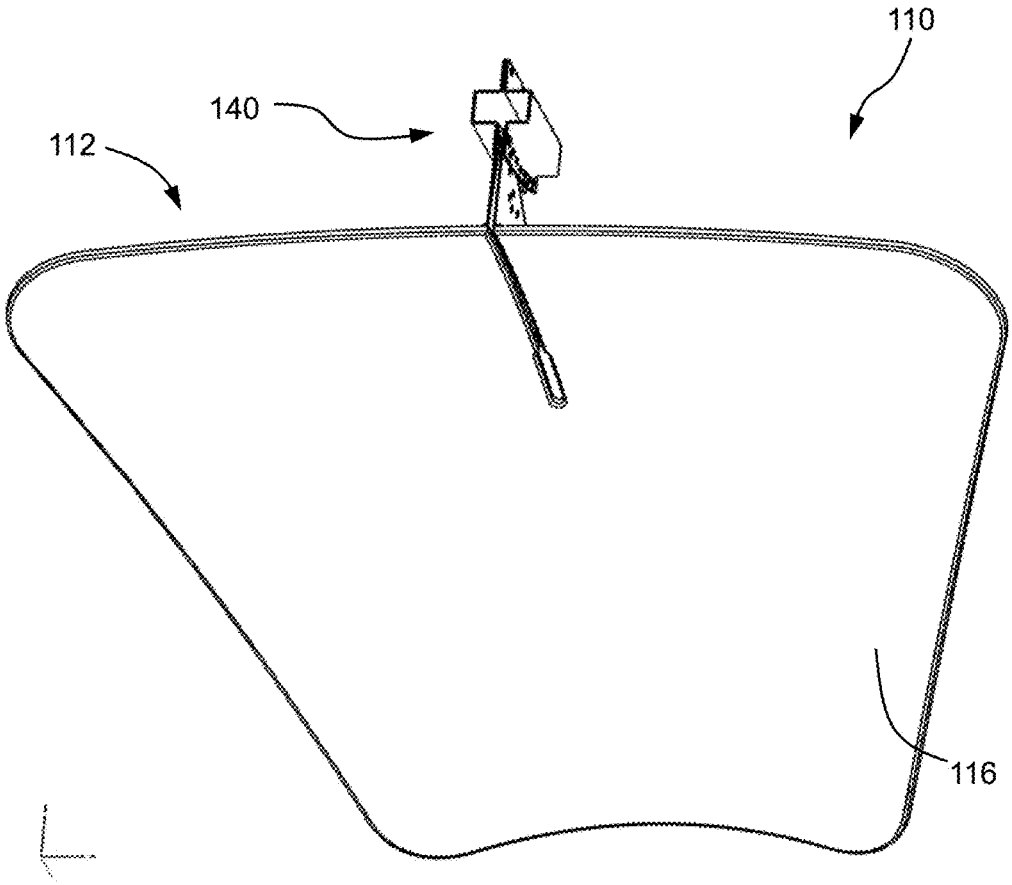
FIG. 3 is a schematic lower perspective view of the ceiling panel of FIG. 1.

In certain embodiments of the ceiling panel as otherwise described herein, the entire lower surface is unencumbered. The description of a surface or section of the panel body as being unencumbered, as set forth herein, means that this surface or section is void of any attachments or protrusions and does not include any protruding articles or objects attached thereto. For example, an unencumbered lower surface of the panel body is void of any ornamental or structural elements that extend outward from the lower surface. For example, in some embodiments, the lower surface of the panel body is smooth It should be understood, however, that the term unencumbered does not preclude thin coatings such as paint or overlays such as a fabric or plastic overlay. As shown in FIG. 3, the lower surface 116 of panel body 112 is unencumbered and free of any brackets, attachments, or projecting ornamentation.

In certain embodiments of the ceiling panel as otherwise described herein, the area of the upper surface that surrounds the bracket is unencumbered. Specifically, in some embodiments, the entire area of the upper surface that extends from the bracket to the outer edge of the panel body is free of any protruding articles or objects and void of attachments. For example, as shown in FIG. 1, the entire area of the upper surface 114 of panel body 112 extending from bracket 140 to the outer edge 128 of panel body 112 is unencumbered, in that it is void of protrusions and attachments. Again, the term unencumbered should not be interpreted to exclude coatings or overlays.

In certain embodiments of the ceiling panel as otherwise described herein, a perimeter of the panel body along the first lateral side, second end, and second lateral side is free and unattached. The term perimeter of the panel body, as used herein, includes the outer edge of the panel body as well as an area adjacent to the outer edge, for example, within 1 inch of the outer edge. For example, as shown in FIG. 1, the perimeter of panel body 112 is entirely free and unattached except along first end 118. Thus, the perimeter of panel body 112 along the first lateral side 122, second end 120, and second lateral side 124 is free and unattached, with only the bracket 140 being attached to the panel body 112 along the first end 118.

In certain embodiments of the ceiling panel as otherwise described herein, the panel body has a substantially uniform thickness. For example, in some embodiments, the panel body is made from a sheet or plate of a uniform thickness. The term thickness, as used herein, refers to the local material thickness of the panel body, and not the overall depth of the panel body. Thus, a panel body comprising a sheet of material of a relatively small thickness may be curved and bent such that the overall depth dimension of the panel body is significantly larger than the local thickness of the panel body. Further, the term substantially uniform refers to a thickness that varies no more than 20%, e.g., no more than 10%, e.g., no more than 5%. In ceiling panel 110, panel body 112 is formed as a curved thin sheet that has a substantially uniform thickness.

In certain embodiments of the ceiling panel as otherwise described herein, the panel body is formed of a single material. For example, in some embodiments, the panel body is integrally formed as a single piece made of one material. It should be understood that, where the panel body is formed of a single material it may still be covered with a coating or an overlay.

In certain embodiments as otherwise described herein, the panel body is formed of sheet metal. The term metal strip, as used herein, is not limited to any particular thickness and may include materials conventionally referred to as metal foil or metal plate. In other embodiments, the panel body is formed of another material, such as wood or plastic.

In certain embodiments of the ceiling panel as otherwise described herein, the panel body is formed of a laminate. For example, in some embodiments the panel body is formed of layers of material that are bonded to one another. For example, in some embodiments, the panel body is formed of layers of plastic material. Further, in some embodiments the panel body is formed of a wood laminate. Further still, in some embodiments, the panel body is formed of layers of different materials.

Figure 5:
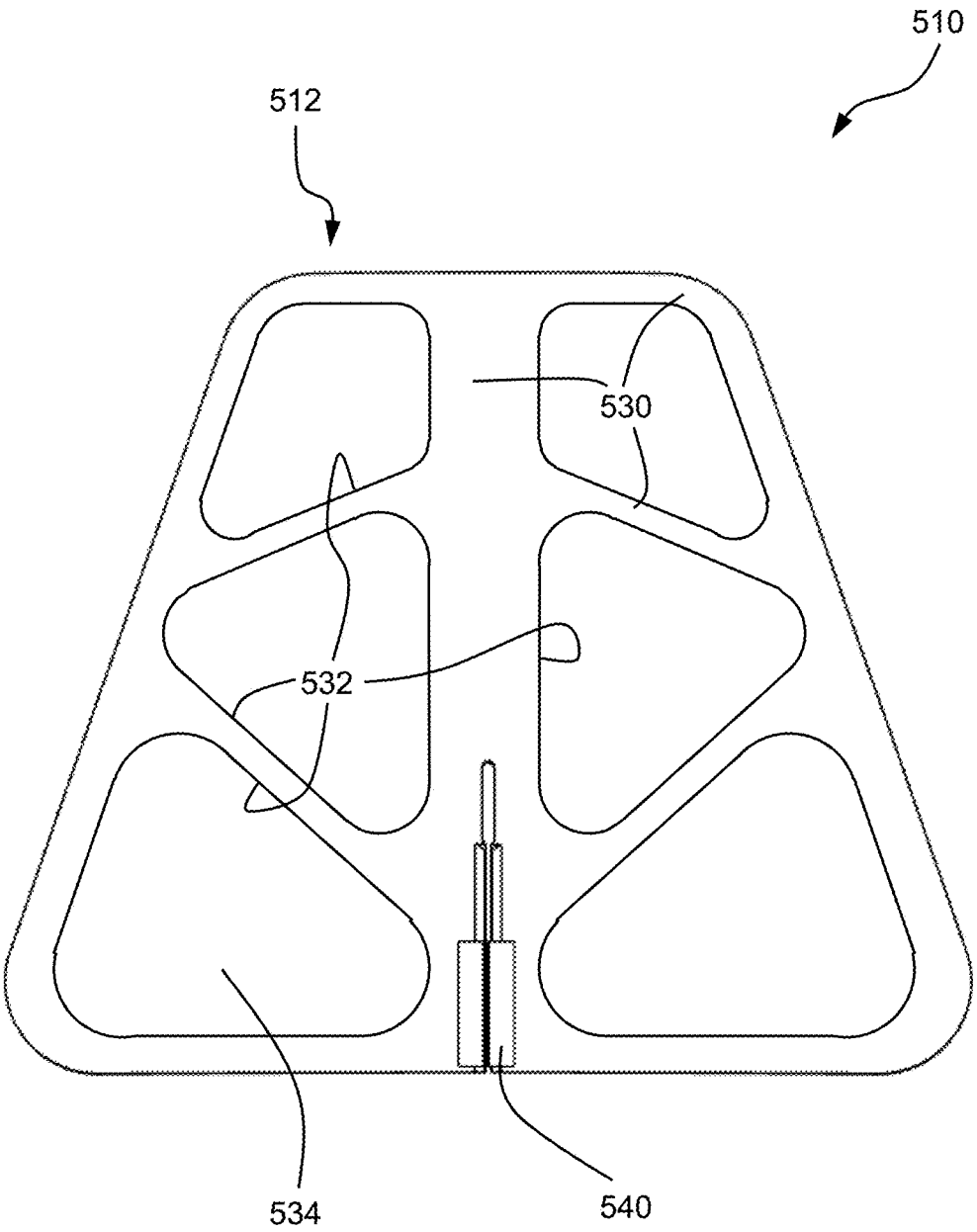
FIG. 5 is a schematic top view of a ceiling panel according to another embodiment of the disclosure.

In certain embodiments of the ceiling panel as otherwise described herein, the panel body is formed of more than one material. For example, in some embodiments the panel body includes a section formed of one material and another section formed of a second material. In some embodiments, the panel body includes a structural element of a first material that is covered by a second material, such that only the second material is visible. For example, in some embodiments the panel body includes a frame formed by a first material, and the lower surface of the panel body is formed by a second material. Such a ceiling panel is shown in a schematic top view in FIG. 5. Ceiling panel 510 includes a bracket 540 and a panel body 512 that includes a frame 530 formed of sheet metal and a sheet 534 of a second material disposed on the lower side of the frame so as to form the lower surface of the panel body 512. The frame 530 includes apertures 532 in order to reduce the amount of metal material used in the panel body 512. In some embodiments, the sheet is a fabric sheet. In other embodiments, the sheet is a layer of plastic. Still, in other embodiments, the frame is surrounded by the second material. For example, in some embodiments the frame is a stronger material, such as metal, that is embedded in a second lighter material, such as a foam material or light plastic. Likewise, in some embodiments, the frame is held in a sleeve, such as a fabric sleeve, that contains the frame therein.

In other embodiments the panel body is formed by two or more materials and both materials are viewable. For example, in some embodiments a first portion of the lower surface of the panel body is formed by one material and a second portion of the lower surface is formed by another material. Other configurations using multiple materials are also possible.

In certain embodiments of the ceiling panel as otherwise described herein, the lower surface of the panel body is covered by a coating. For example, in some embodiments the lower surface of the panel body is covered by at least one layer of paint. The term layer of paint, as used herein, includes primer and pigmented paints. Other coatings are also possible, such as reflective coatings or moisture barriers. Further, in some embodiments, both the upper and lower surfaces are covered by a coating.

In certain embodiments of the ceiling panel as otherwise described herein, the lower surface of the panel body is covered by an overlay. For example, in some embodiments, the lower surface of the panel body is covered by a layer of fabric, such as felt. In other embodiments, the lower surface of the panel body is covered with a polymer sheet. In some embodiments the overlay has a single color. In other embodiments, the overlay is ornamented with a graphic design that includes various shades or colors. In some embodiments, the overlay is attached to the lower surface of the panel body with an adhesive. For example, in some embodiments, the overlay is a decal.

In certain embodiments of the ceiling panel as otherwise described herein, at least a portion of the panel body is transparent. For example, in some embodiments, the panel body includes a frame formed of an opaque material and the lower surface is covered by a transparent fabric or plastic. In other embodiments, the entire panel body is formed of a transparent material. Forming a portion of the panel body as transparent allows the panel body to allow light through, such as from a light source. Thus, lighting may be provided behind (or above) a ceiling panel that includes a partially or wholly transparent panel body without blocking light from the underlying space.

In certain embodiments of the ceiling panel as otherwise described herein, the panel body forms a diffuser. For example, in some embodiments, the ceiling panel cooperates with a light source to spread light throughout the underlying surface. Thus, such a ceiling panel acts as a part of the lighting design of the architectural space. In some embodiments, the entire panel body is formed as a diffuser. In other embodiments, only a portion of the panel body forms a diffuser.

Figure 4:
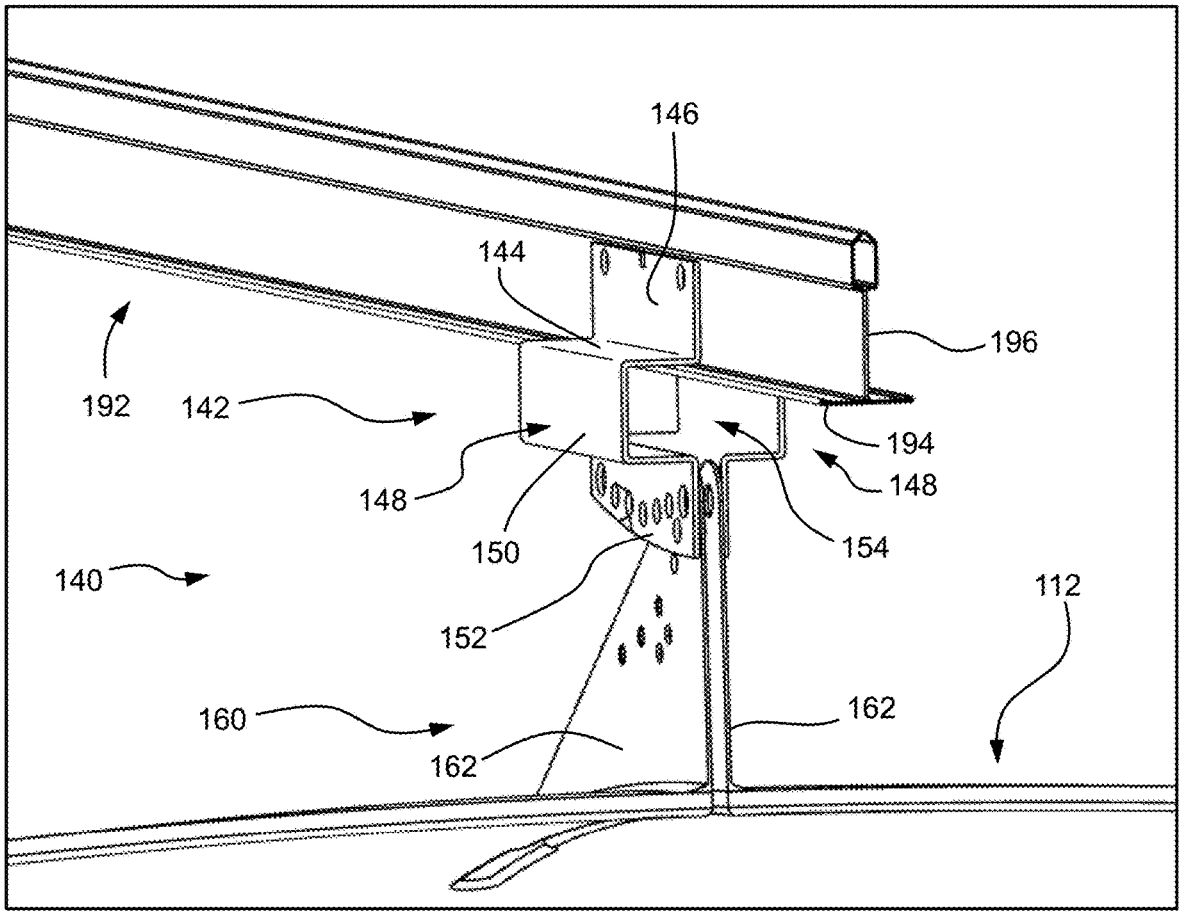
FIG. 4 is a detailed view of a portion of the ceiling panel of FIG. 1 attached to a frame element.

In certain embodiments of the ceiling panel as otherwise described herein, the upper fastener of the bracket includes a support flange configured to hook over a horizontal flange of the frame member of the ceiling grid. For example, as shown in FIG. 4, upper fastener 142 of bracket 140 of ceiling panel 110 includes a support flange 144 that is configured to hook over a horizontal flange 194 of frame member 192 of a ceiling grid. Accordingly, support flange 144 engages the frame member 192 to provide vertical support for the ceiling panel 110.

In certain embodiments of the ceiling panel as otherwise described herein, the upper fastener of the bracket includes an upper web plate configured to connect to a vertical web of the frame member of the ceiling grid. For example, upper fastener 142 of bracket 140 of ceiling panel 110 also includes an upper web plate 146 that is configured to connect to a vertical web 196 of frame member 192 of ceiling grid 190. In particular, the surface of upper web plate 146 of upper fastener 142 is secured to the surface of vertical web 196 of frame member 192.

Frame member 192 of ceiling grid 190, as shown in FIG. 4, is in the form of a T-beam that includes both a horizontal flange 194 and a vertical web 196. The upper fastener 142 of bracket 140 uses both of these portions of frame member 192 to mount the ceiling panel 110. In particular, support flange 144 hooks over the horizontal flange 194 and upper web plate 146, which extends upward from support flange 144 is also attached to the vertical web 196. However, in other embodiments, upper fastener 142 may couple to a frame member that includes only a horizontal flange or only a vertical web. For example, the support flange 144 of upper fastener 142 may hook over a beam that includes a horizontal flange but does not include a vertical web. Likewise, upper web plate 146 of upper fastener 142 may attach to a vertical plate (or vertical web) of a frame member that does not have a corresponding horizontal flange.

Further, in some embodiments, the upper fastener does not include both a horizontal support flange and an upper web plate. For example, in some embodiments, the upper fastener includes a support flange without an upper web plate. Likewise, in other embodiments the upper fastener includes an upper web plate without a support flange. Still, other structures for securing the upper fastener to a frame member are also possible.

In some embodiments, the upper fastener is configured to secure to the frame member using mechanical fasteners, such as screws or bolts. For example, upper fastener 142 of bracket 140 of ceiling panel 110 includes holes for attaching the upper fastener to a frame member. In particular, the upper web plate 146 of upper fastener 142 includes holes for securing the upper fastener 142 to the vertical web 196 of frame member 192. In other embodiments, the upper fastener is configured to be secured to the frame member using mechanical fasteners that pass through the support flange of the upper fastener. Further, in some embodiments, the upper fastener is configured to be secured to the frame member using mechanical fasteners that pass through both the support flange and the upper web plate.

In other embodiments, the upper fastener is configured to be secured to the frame member using another structure. For example, in some embodiments, the upper fastener includes downwardly extending tabs configured to hook into slots in the frame member. On the other hand, in some embodiments, the upper fastener includes slots configured to secure over upwardly extending tabs in the frame member. Other systems and structures for securing the upper fastener to the frame member are also possible.

In some embodiments, the upper fastener includes opposing portions that cooperate with opposite sides of frame member. For example, upper fastener 142 of bracket 140 of ceiling panel 110 includes two opposing attachment legs 148. The attachment legs 148 are mirror images of one another and each includes a support flange 144 and an upper web plate 146. Thus, the support flange 144 of each attachment leg 148 extends over one of the horizontal flanges 194 of frame element 192, and the upper web plates 146 of the attachment legs 148 attach to opposing sides of the vertical web 196 of the frame element 192.

In certain embodiments of the ceiling panel as otherwise described herein, the upper fastener of the bracket includes a channel configured to surround a portion of the frame member of the ceiling grid. For example, the attachment legs 148 of upper fastener each include connecting plates 150 that extend from support flange 144 to lower web plate 152. The support flange 144 and connecting plates 150 form a channel 154 that surrounds the horizontal flange 194 of frame member 192. Other configurations of providing a channel that surrounds a portion of a frame member are also possible.

In certain embodiments of the ceiling panel as otherwise described herein, the panel body has a length from the first end to the second end that is at least 6 inches, e.g., at least 12 inches, e.g., at least 18 inches. In some embodiments, the panel body has a length from the first end to the second end that is no more than 120 inches, e.g., no more than 60 inches, e.g., no more than 48 inches. For example, in some embodiments, the panel body has a length that is in a range from 6 inches to 120 inches, e.g., from 12 inches to 60 inches, e.g., from 18 inches to 48 inches.

In certain embodiments of the ceiling panel as otherwise described herein, the panel body has a width from the first lateral side to the second lateral that is at least 6 inches, e.g., at least 12 inches, e.g., at least 18 inches. In some embodiments, the panel body has a width from the first lateral side to the second lateral that is no more than 120 inches, e.g., no more than 60 inches, e.g., no more than 48 inches. For example, in some embodiments, the panel body has a width that is in a range from 6 inches to 120 inches, e.g., from 12 inches to 60 inches, e.g., from 18 inches to 48 inches.

In certain embodiments of the ceiling panel as otherwise described herein, the panel body has a thickness of no more than 25 mm, e.g., no more than 10 mm, e.g., no more than 5 mm, e.g., no more than 2 mm. As explained above, the term panel body thickness refers to the local material thickness of the panel body. In other embodiments, the thickness of the panel body is greater than 25 mm.

In certain embodiments of the ceiling panel as otherwise described herein, the bracket further comprises a lower fastener that attaches to the upper fastener. For example, bracket 140 of ceiling panel 110 includes a lower fastener 160 extending from the panel body 112 that attaches to the upper fastener 142. In other embodiments, however, the upper fastener of the bracket is secured directly to the panel body.

In certain embodiments of the ceiling panel as otherwise described herein, the attachment between the upper fastener and lower fastener is adjustable and provides the adjustability of the angle of the panel body. For example, in some embodiments, at least one of the upper fastener and the lower fastener includes a plurality of openings for selectable connection with the other of the upper fastener and lower fastener. In bracket 140 of ceiling panel 110, both upper fastener 142 and lower fastener 160 include a plurality of openings for attaching to one another using mechanical fasteners, such as bolts. For example, different sets of the openings can be aligned with one another to secure the lower fastener 160 and the upper fastener 142 at various different angles. As a result, the angle of the panel body 112 may be adjusted with respect to the plane of the ceiling grid.

In certain embodiments of the ceiling panel as otherwise described herein, the lower fastener includes a fin that extends upward from the upper surface of the panel body. For example, as shown in FIG. 4, lower fastener 160 of bracket 140 includes a fin 162 that extends upward from panel body 112 and is secured to upper fastener 142.

In certain embodiments of the ceiling panel as otherwise described herein, the upper fastener includes a lower web plate that attaches to the fin of the lower fastener. For example, as explained above, upper fastener 142 includes a pair of lower web plates 152 that extend downward from channel 154 and are respectively secured to opposing walls of fin 162 of lower fastener 160. While fin 162 of lower fastener 160 includes a pair of walls, in other embodiments the fin is formed by a single wall.

In certain embodiments of the ceiling panel as otherwise described herein, the lower fastener is integrally formed with the panel body in a single piece. For example, in some embodiments, as in ceiling panel 110, the fin may formed by a section of sheet metal that is bent outward from the panel body. Likewise, in some embodiments the fin or fins and the panel body are formed in a single molded, cast, or machined piece. Alternatively, in other embodiments, the fin or fins of the lower fastener is attached to the panel body. For example, in some embodiments the fin is welded to the panel body. In other embodiments, the fin is formed with a flange that is attached to the panel body, either using mechanical fasteners, an adhesive, or another method.

Figure 6:
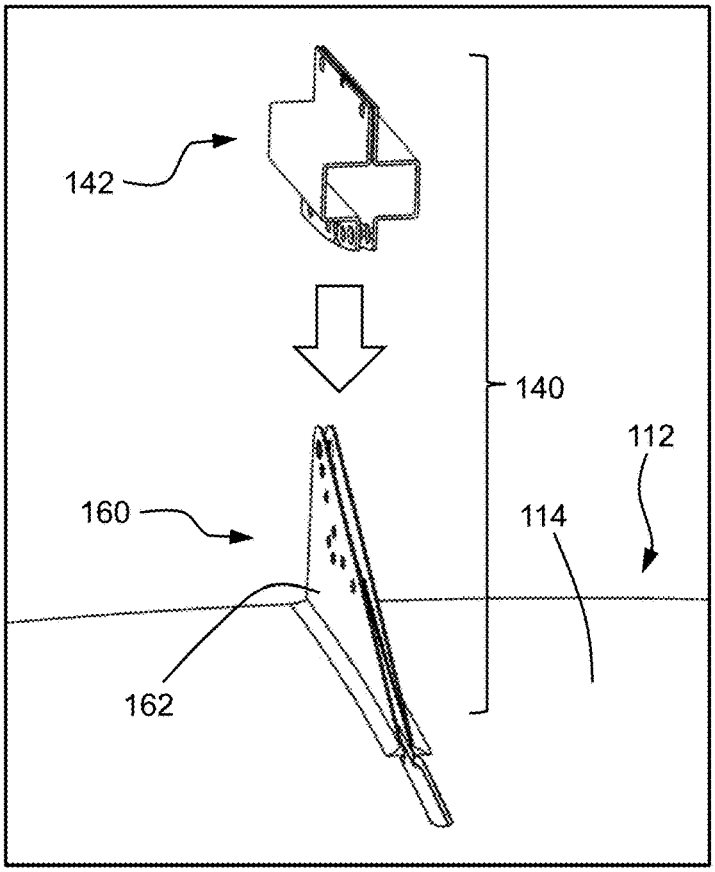
FIG. 6 is a schematic perspective view showing part of a method of making the ceiling panel of FIG. 1.
Figure 7:
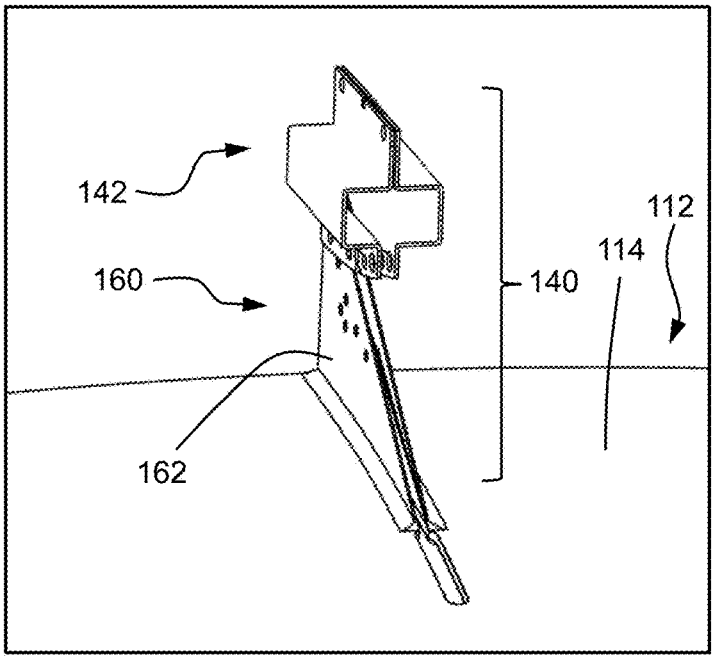
FIG. 7 is a schematic perspective view showing another part of the method of making the ceiling panel of FIG. 1.

In another aspect, the disclosure provides a method of forming a ceiling panel according to the disclosure, the method includes forming the panel body, forming a fin of a lower fastener of the bracket on the upper surface of the panel body, and attaching the upper fastener of the bracket to the fin of the lower fastener of the bracket. For example, as shown in FIG. 6, the fin 162 of the lower fastener 160 of bracket 140 is formed on upper surface 114 of panel body 112. The upper fasteners 142 of bracket 140 is then attached to the fin 162 of lower fastener 160, as shown in FIG. 7.

In certain embodiments of the method as otherwise described herein, the panel body and the fin are formed from a single sheet of material. For example, in some embodiments, the panel body and the fin are both formed of bent sheet metal.

Figure 8:
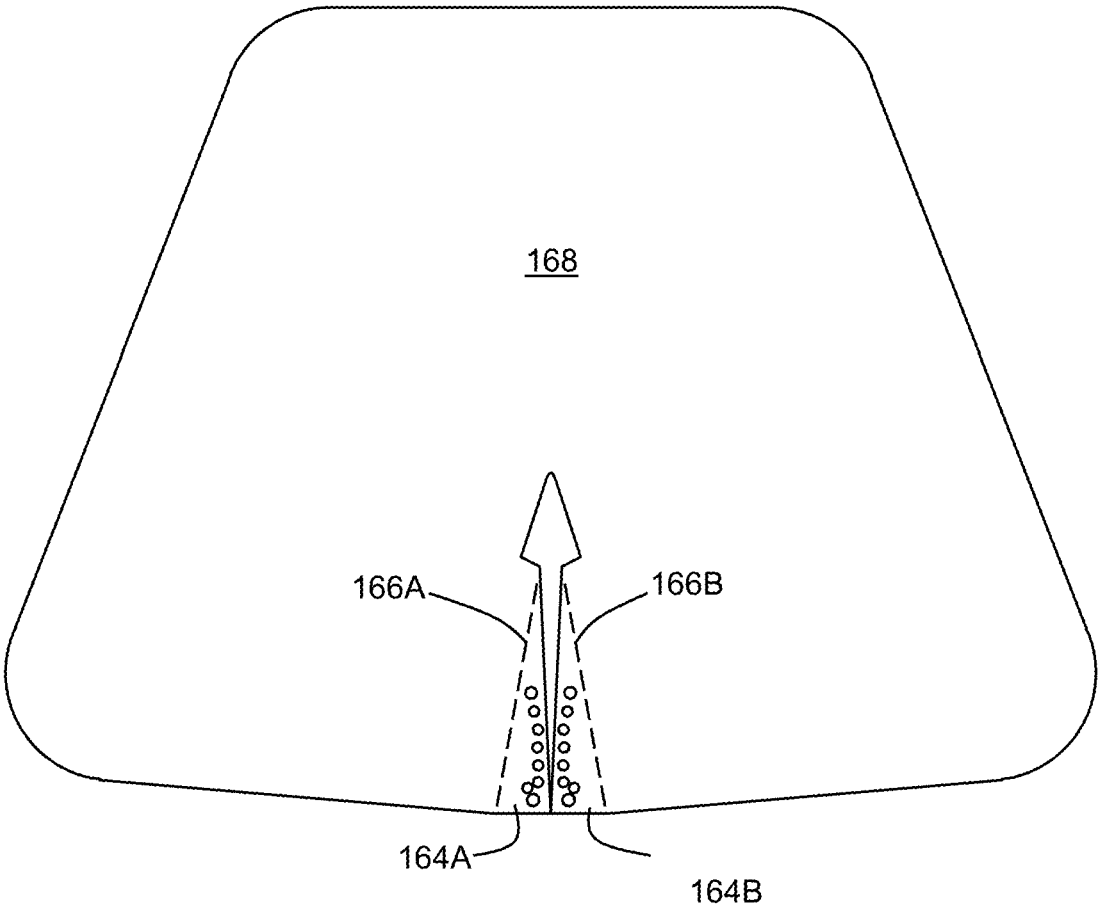
FIG. 8 is a top view of a part illustrating the method of making the ceiling panel of FIG. 1.

In certain embodiments of the method as otherwise described herein, forming the fin includes bending the single sheet of material along a first crease to form a first wall of the fin and along a second crease to form a second wall of the fin. For example, as shown in FIG. 8, a sheet of material 168 is cut into a predefined shape. A first wall 164A of the fin is bent along a first crease 166A and, likewise, a second wall 164B of the fin is bent along a second crease 166B. The walls 164A and 164B may then be joined to form the fin while the sheet of material forms the panel body.

In certain embodiments of the method as otherwise described herein, forming the fin includes bringing the first crease and the second crease together such that the lower surface of the panel body curves and the first wall of the fin is adjacent to the second wall of the fin. For example, by bringing first crease 166A of sheet of material 168 together with second crease 166B, such that the first wall 164A is placed adjacent to second wall 164B, the sheet of material 168 will curve to form a panel body while the two walls 164A, 164B form the fin 162 of lower fastener 160 of ceiling panel 110 (as shown in FIG. 1).

Figure 9:
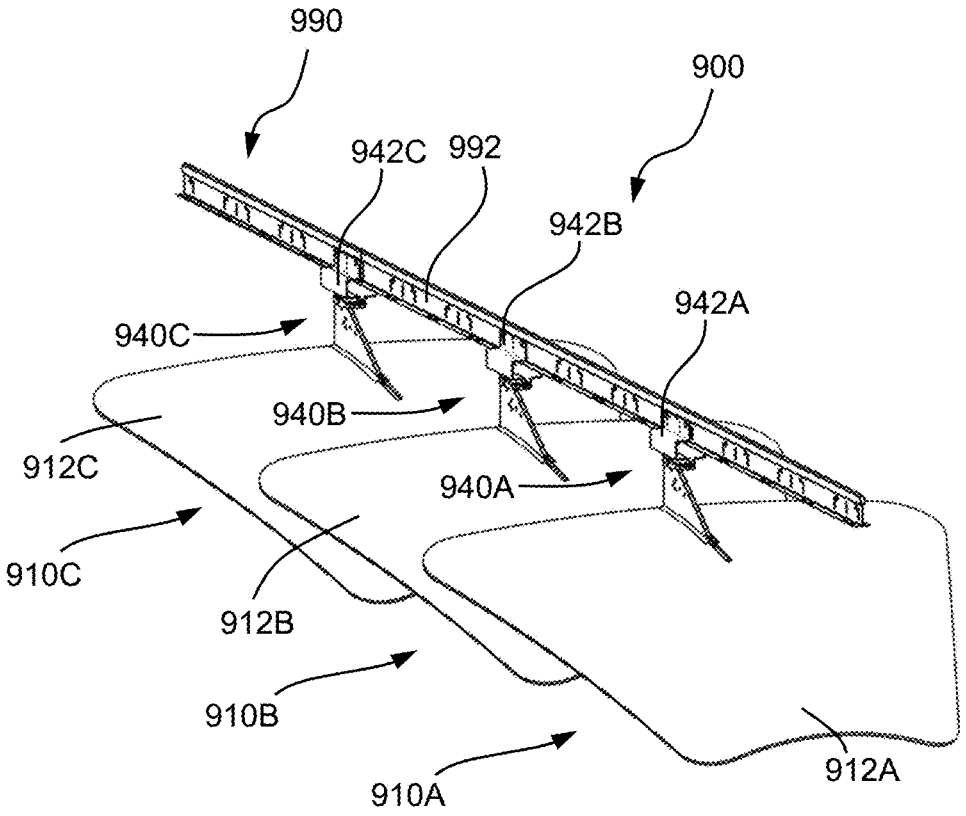
FIG. 9 is a schematic perspective view of a ceiling system according to an embodiment of the disclosure.

In another aspect, the disclosure provides a ceiling system including a ceiling grid formed by a plurality of frame elements including a first frame element, a first ceiling panel according to the disclosure attached to the first frame element and a second ceiling panel according to the disclosure also attached to the first frame element. Such a ceiling system is shown in FIG. 9. Ceiling system 900 includes a first frame element 992 that is part of a larger ceiling grid 990 including other frame elements that are not shown. The first frame element 992 is in the form of a T-grid that includes a vertical web and two lower horizontal flanges. A first ceiling panel 910A is attached to the first frame element 992 by a bracket 940A using an upper fastener 942A that connects to the first frame element 992. The bracket 940A is attached to the panel body 912A of the ceiling panel 910A at a position that is offset from the center of gravity of the panel body 912A. A second ceiling panel 910B is also attached to first frame element 992 by a bracket 940B using an upper fastener 942B that connects to the first frame element 992. Likewise, a third ceiling panel 910C is attached to first frame element 992 by a bracket 940C using an upper fastener 942C that connects to the first frame element.

In certain embodiments of the ceiling system as otherwise described herein, the first ceiling panel is attached to the ceiling grid only by an attachment of the bracket of the first ceiling panel to the first frame element. For example, first ceiling panel 910A is attached to ceiling grid 990 only via the attachment of bracket 940A to first frame element 942A. No other part of ceiling panel 910A is hung from, attached to, or rests on any part of ceiling grid 990.

In certain embodiments of the ceiling system as otherwise described herein, an outer edge of the panel body of the first ceiling panel is free. For example, because first ceiling panel 910A is attached to ceiling grid 990 only via bracket 940A, the entire outer edge of panel body 912A can hang freely without resting on any portion of the ceiling grid, in contrast to typical ceiling panels.

In certain embodiments of the ceiling system as otherwise described herein, a second end of the first ceiling panel overlaps the first end of the second ceiling panel. For example, a portion of panel body 912A of second ceiling panel 910A at the second end 920A of panel body 912A is positioned below a portion of panel body 912B of second ceiling panel 910B at the first end 918B so as to overlap one another. Portions of panel body 912C and panel body 912B overlap similarly.

In certain embodiments of the ceiling system as otherwise described herein, the first ceiling panel and second ceiling panel are both attached to the first frame element at the same angle. For example, both the panel body 912A of first ceiling panel 910A and the panel body 912B of second ceiling panel 910B are both positioned at the same angle. Accordingly, in a row of such panels, the overlap between panels is uniform providing a repeating design.

Figure 10A:
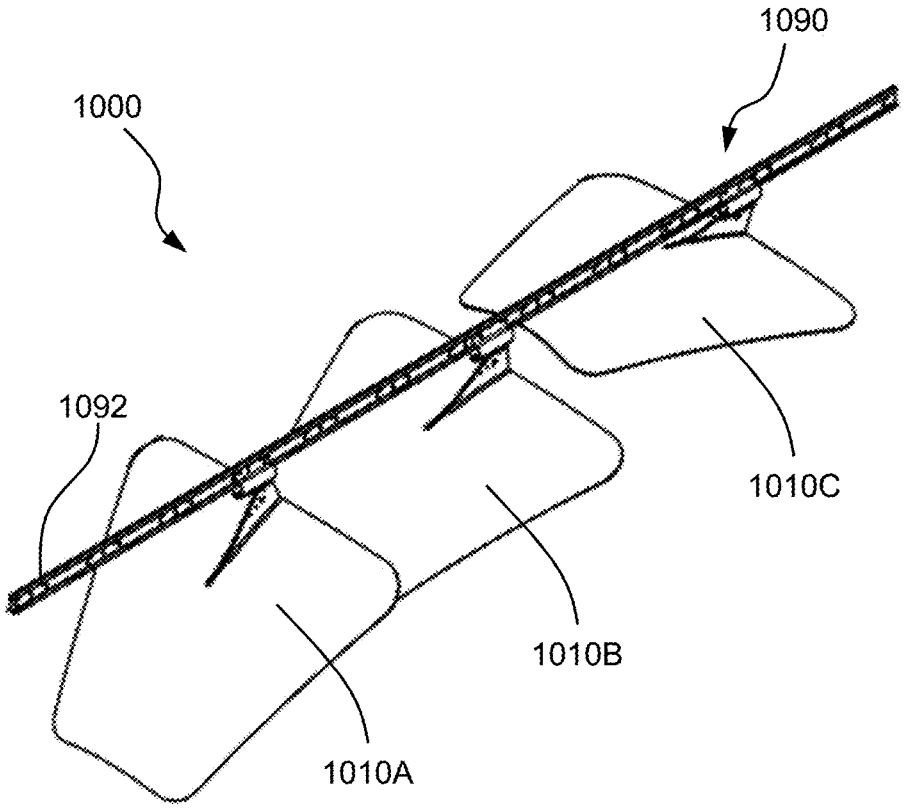
FIG. 10A is a schematic perspective view of a ceiling system according to another embodiment of the disclosure.
Figure 10B:
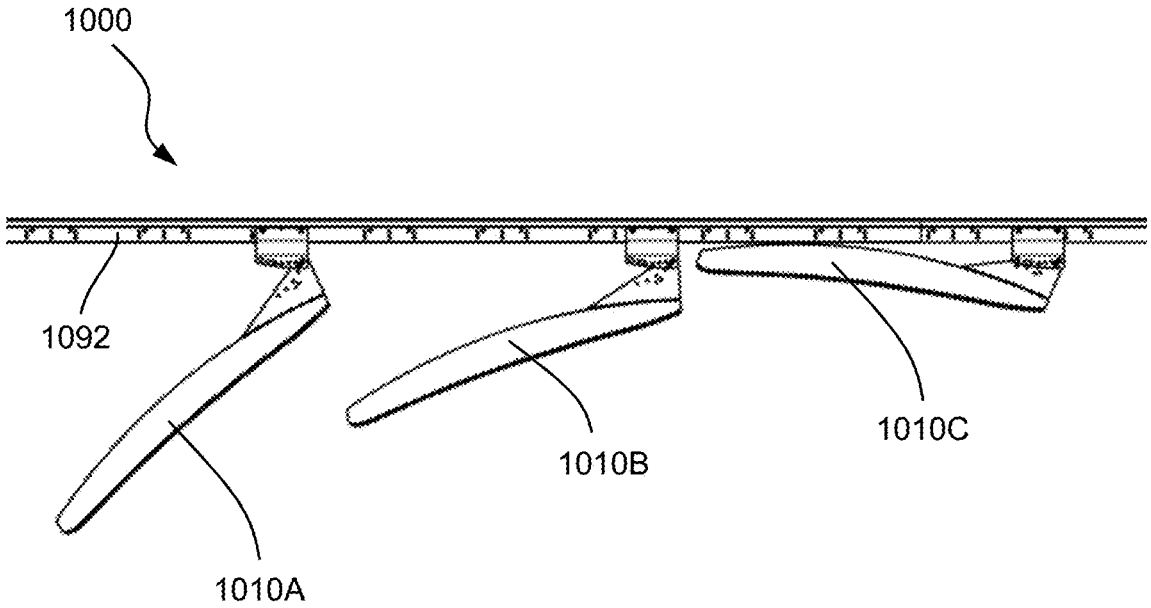
FIG. 10B is a schematic side view of the ceiling system of FIG. 10A.

In contrast, in some embodiments, the first ceiling panel is attached to the first frame element at a first angle and the second ceiling panel is attached to the first frame element at a second angle that is different from the first angle. For example, in some embodiments, the panel body of the first ceiling panel is disposed at a steeper angel than the panel body of the second ceiling panel. Such a ceiling system is shown in FIGS. 10A and 10B, where FIG. 10A is an elevated perspective view and FIG. 10B is a side view showing the variation in angles of the ceiling panels. Ceiling system 1000 includes a first frame element 1092 that is part of a larger ceiling grid 1090 including other frame elements that are not shown. Ceiling system 1000 includes a first ceiling panel 1010A attached to first frame element 1092 and disposed at a first angle. Ceiling system 1000 also includes a second ceiling panel 1010B attached to first frame element 1092 and disposed at a second angle that is different from the angle of first ceiling panel 1010A. In particular, first ceiling panel 1010A is disposed at a very steep angle with respect to first frame element 1092 while second ceiling panel 1010B is disposed at a shallower angle. Ceiling system 1000 also includes a third ceiling panel 1010C that is disposed at an even shallow angle with respect to the first frame element 1092. In other embodiments, the panel body of the second ceiling panel is at a steeper angle than the panel body of the first ceiling panel. Further, in some embodiments, such a variation in the angles of the ceiling panels repeats in a pattern along the length of the frame element. In other embodiments, the angle of the ceiling panels varies randomly along the length of the frame element. Other sequences and patterns are also possible.

Figure 11A:
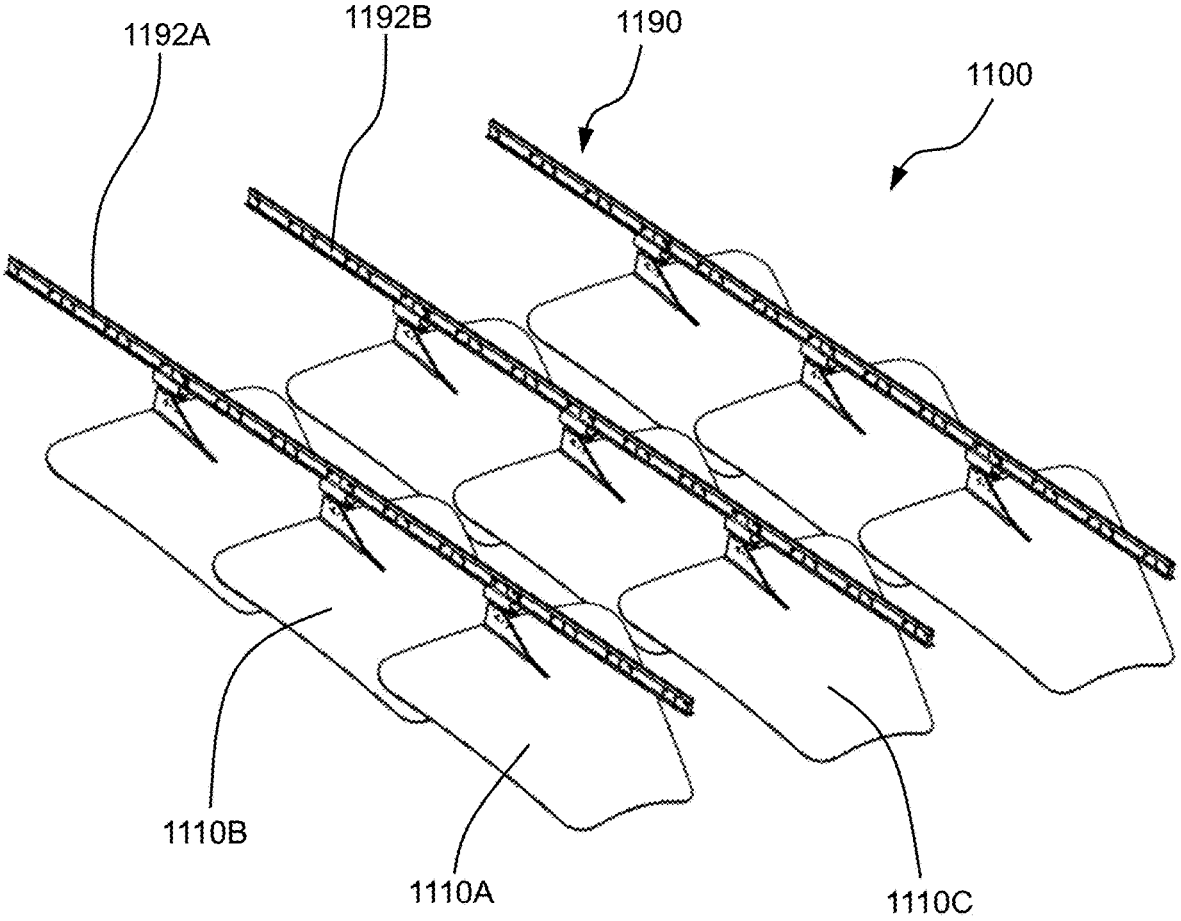
FIG. 11A is a schematic elevated perspective view of a ceiling system according to another embodiment of the disclosure.
Figure 11B:
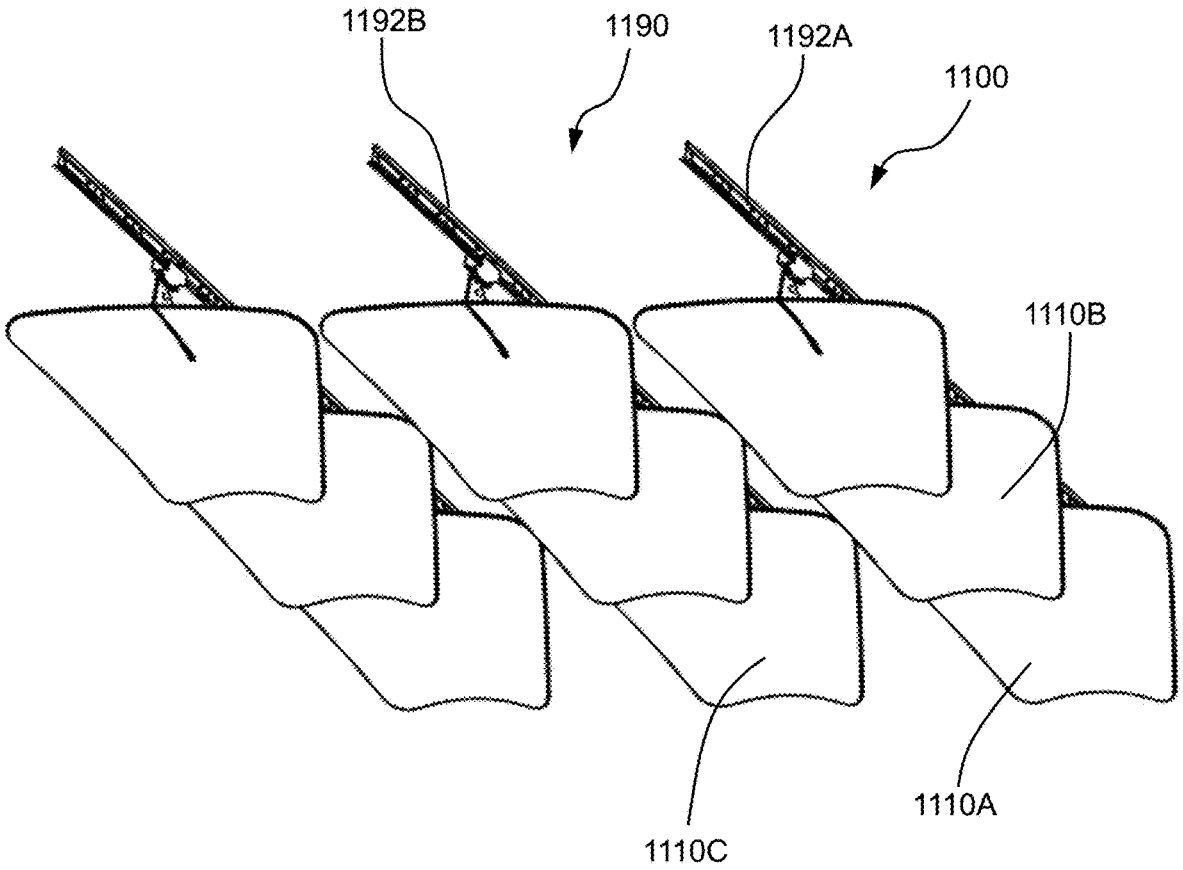
FIG. 11B is a schematic lower perspective view of the ceiling system of FIG. 11A.

In certain embodiments of the ceiling system as otherwise described herein, the ceiling system further includes a second frame element that is parallel to the first frame element, and a third ceiling panel attached to the second frame element. Such a ceiling system is shown in FIGS. 11A and 11B, where FIG. 11A is an elevated perspective view of the ceiling system and FIG. 11B is viewed from below the ceiling system. Ceiling system 1100 includes a ceiling grid 1190 having a first frame element 1192A and a second frame element 1192B. Ceiling system 1100 also includes a plurality of ceiling panels attached to the frame elements. For example, ceiling system 1100 includes first ceiling panel 1110A and second ceiling panel 1110B attached to first frame element 1192A. Further, ceiling system 1100 also includes a third ceiling panel 1110C that is attached to second frame element 1192B. Ceiling system 1100 also includes additional frame elements and further ceiling panels attached to each frame element.

Figure 12A:
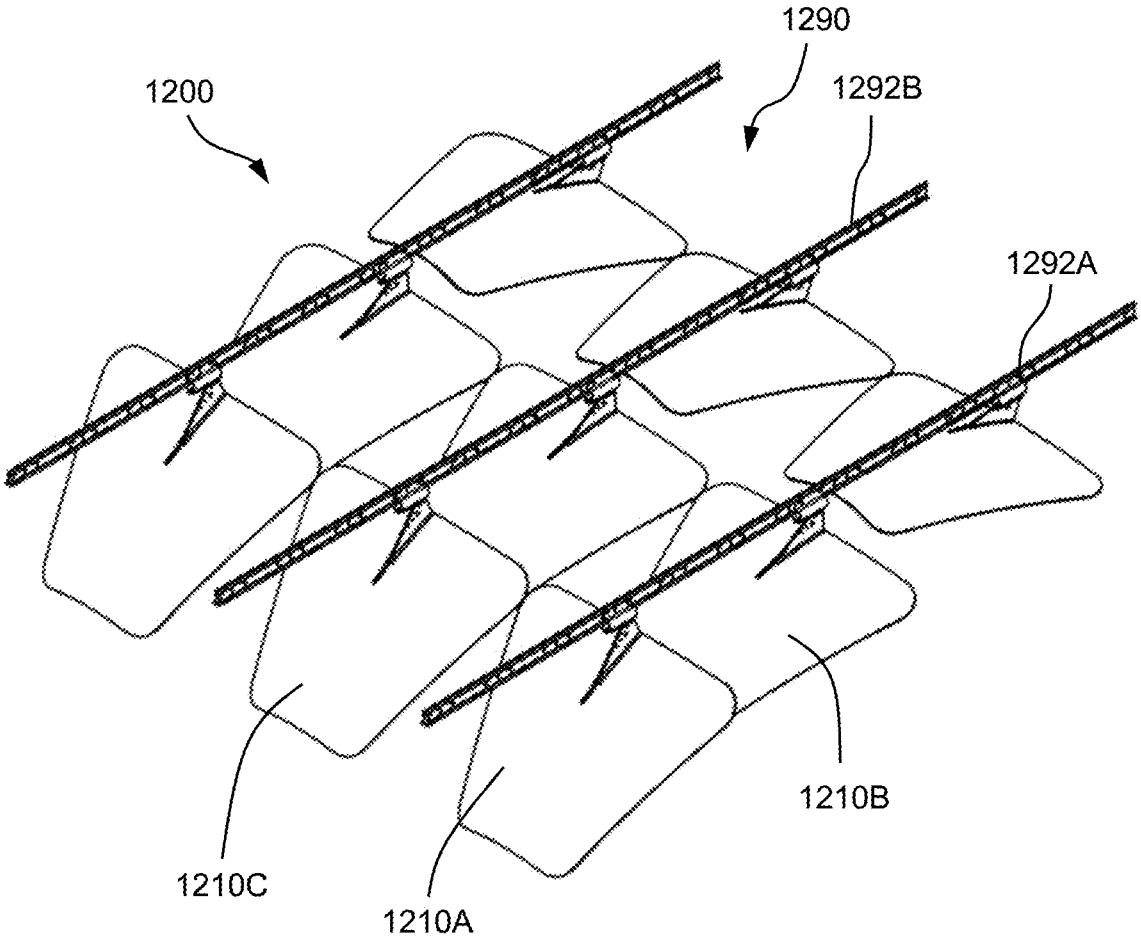
FIG. 12A is a schematic elevated perspective view of a ceiling system according to yet another embodiment of the disclosure.
Figure 12B:
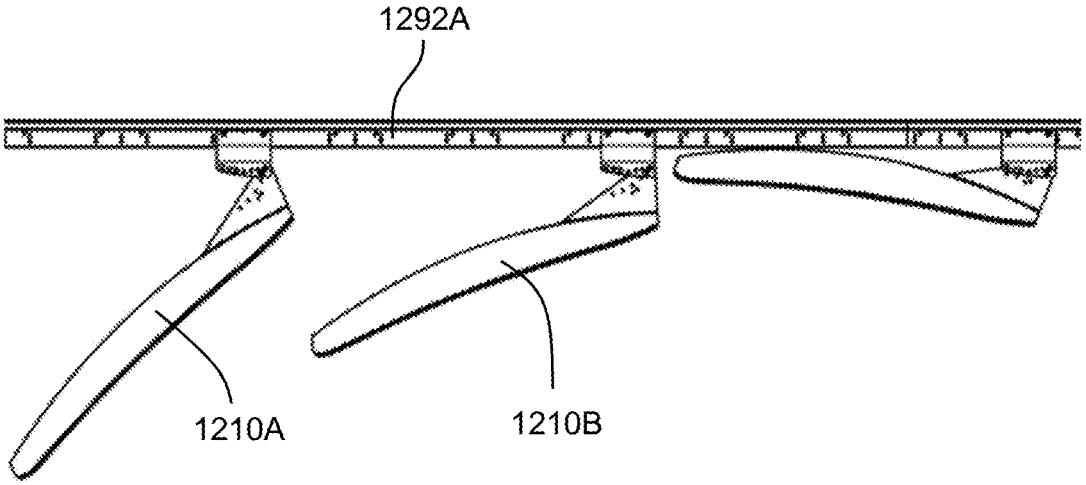
FIG. 12B is a schematic side view of the ceiling system of FIG. 12A.

FIGS. 12A and 12B show another such ceiling system, where FIG. 12A is an elevated perspective view and FIG. 12B is a side view showing a variation in angles of the ceiling panels. Ceiling system 1200 includes a ceiling grid 1290 having a first frame element 1292A and a second frame element 1292B. Ceiling system 1200 also includes a plurality of ceiling panels attached to the frame elements and disposed at varying angles along the length of the frame elements. For example, ceiling system 1200 includes first ceiling panel 1210A and second ceiling panel 1210B attached to first frame element 1292A. First ceiling panel 1210A is disposed at a steeper angle than second ceiling panel 1210B. Further, ceiling system 1200 also includes a third ceiling panel 1210C that is attached to second frame element 1292B. Ceiling system 1200 also includes additional frame elements and further ceiling panels attached to each frame element.

In certain embodiments of the ceiling system as otherwise described herein, the third ceiling panel is aligned with the first ceiling panel along the length of the frame elements. For example, in ceiling system 1100, the ceiling panels 1110 are arranged along the frame elements 1192 in columns and are also aligned in rows from one frame element to a neighboring parallel frame element. Thus, as shown, third ceiling panel 1110C is aligned along the length of the frame elements with first ceiling panel 1110A. Ceiling system 1200 is similarly arranged, with the ceiling panels 1210 arranged in aligned rows across the columns formed by frame elements 1292. Thus, third ceiling panel 1210C is aligned along the length of the frame elements with first ceiling panel 1210A.

Figure 13A:
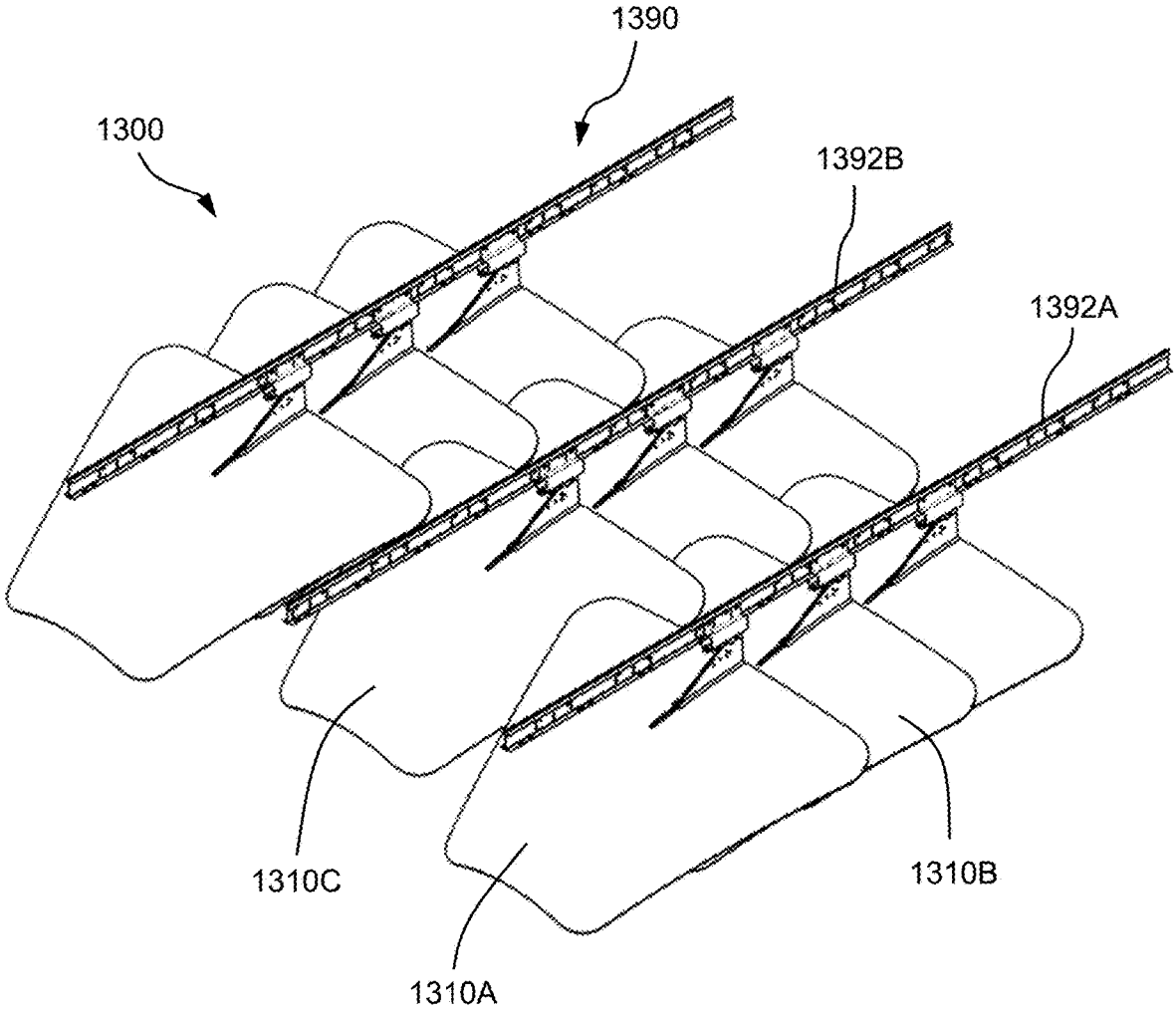
FIG. 13A is a schematic elevated perspective view of a ceiling system according to another embodiment of the disclosure
Figure 13B:
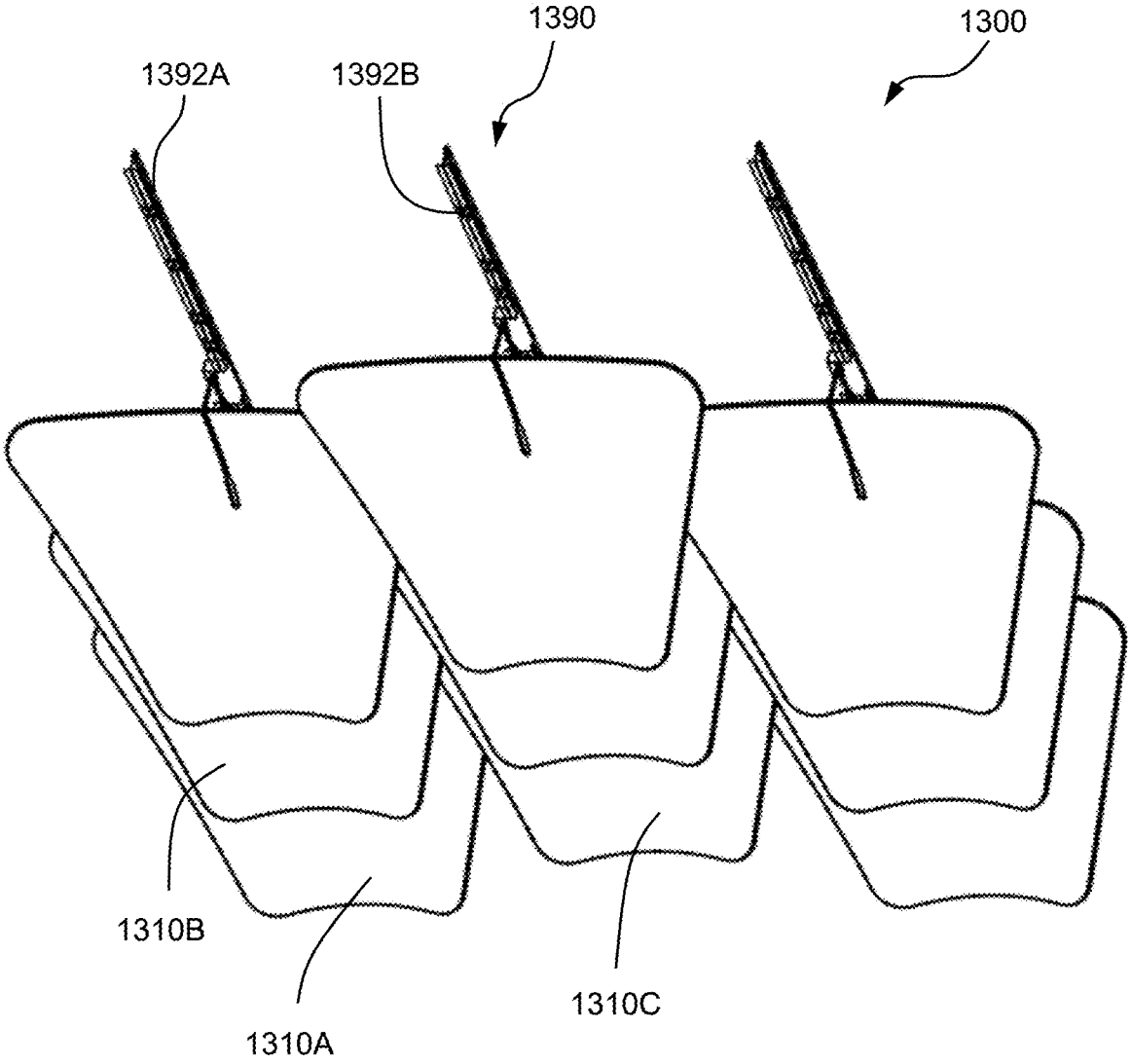
FIG. 13B is a schematic lower perspective view of the ceiling system of FIG. 13A.

In certain embodiments of the ceiling system as otherwise described herein, the ceiling panels are offset along the length of the frame elements from one frame element to the next. Accordingly, in some embodiments, the third ceiling panel is offset between the first ceiling panel and the second ceiling panel along the length of the frame elements. For example, such a ceiling system is schematically shown in FIGS. 13A and 13B, where FIG. 13A is an elevated perspective view of the ceiling system and FIG. 13B is a view from below the ceiling system. Ceiling system 1300 includes a ceiling grid 1390 having a first frame element 1392A and a second frame element 1392B. Ceiling system 1300 also includes a plurality of ceiling panels attached to the frame elements. For example, a first ceiling panel 1310A and a second ceiling panel 1310B are attached along the length of first frame element 1392A forming a column of ceiling panels along first frame element 1392A. Ceiling system 1300 also includes a third ceiling panel 1310C that is attached to second frame element 1392B and is part of another column of ceiling panels. The ceiling panels in the column attached to second frame element 1392B are offset from the ceiling panels in the column attached to first frame element 1392A with respect to the direction that runs along the length of the frame elements. Thus, third ceiling panel 1310C is offset between first ceiling panel 1310A and second ceiling panel 1320B with respect to the direction that runs along the length of the frame elements 1392A and 1392B. Offsetting the position of ceiling panels along the length of frame elements between neighboring columns, allows the frame elements to be positioned more closely together, because the ceiling panels attached to one frame element can overlap the ceiling panels attached to an adjacent frame element, as shown in FIGS. 13A and 13B. In particular, such a configuration allows the frame elements to be spaced at a distance that is less than the width of the ceiling panels.

Figure 14A:
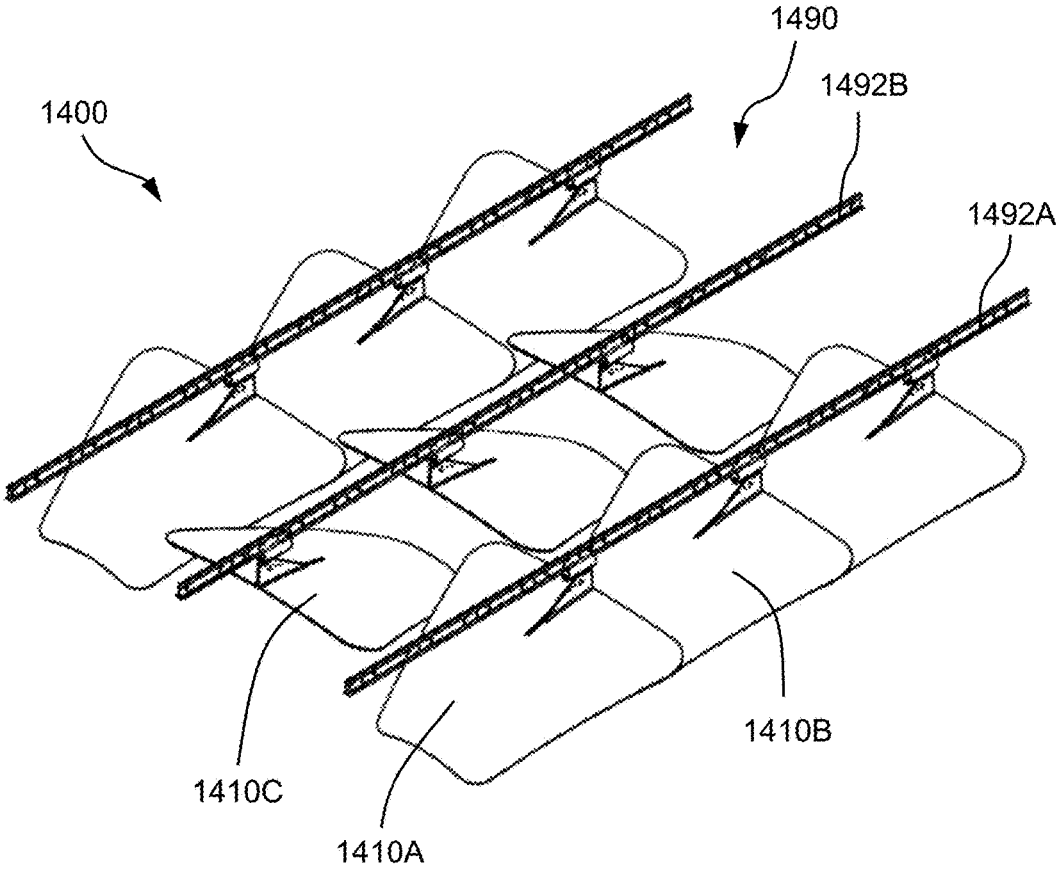
FIG. 14A is a schematic elevated perspective view of a ceiling system according to yet another embodiment of the disclosure.
Figure 14B:
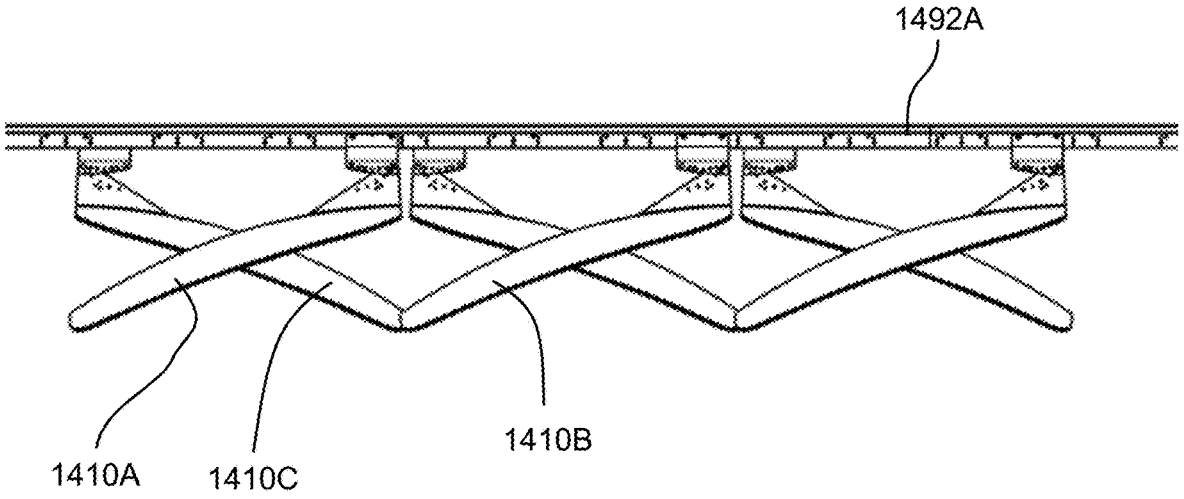
FIG. 14B is a schematic side view of the ceiling system of FIG. 14A.

In certain embodiments of the ceiling system as otherwise described herein, the first and second ceiling panels project in a first direction and the third ceiling panel projects in a second direction that is opposite the first direction. Such a ceiling system is shown in FIGS. 14A and 14B. Ceiling system 1400 includes a ceiling grid 1490 having a first frame element 1492A and a second frame element 1492B. Ceiling system 1400 also includes a plurality of ceiling panels attached to the frame elements. For example, ceiling system 1400 has a plurality of ceiling panels arranged in a column and attached to first frame element 1492, including first ceiling panel 1410A and second ceiling panel 1410B, that both extend in a first direction. Further, ceiling system 1400 also includes ceiling panels attached to a second frame element 1492B, including a third ceiling panel 1410C, that extend in a direction opposite to those attached to first frame element 1492A.

Figure 15:
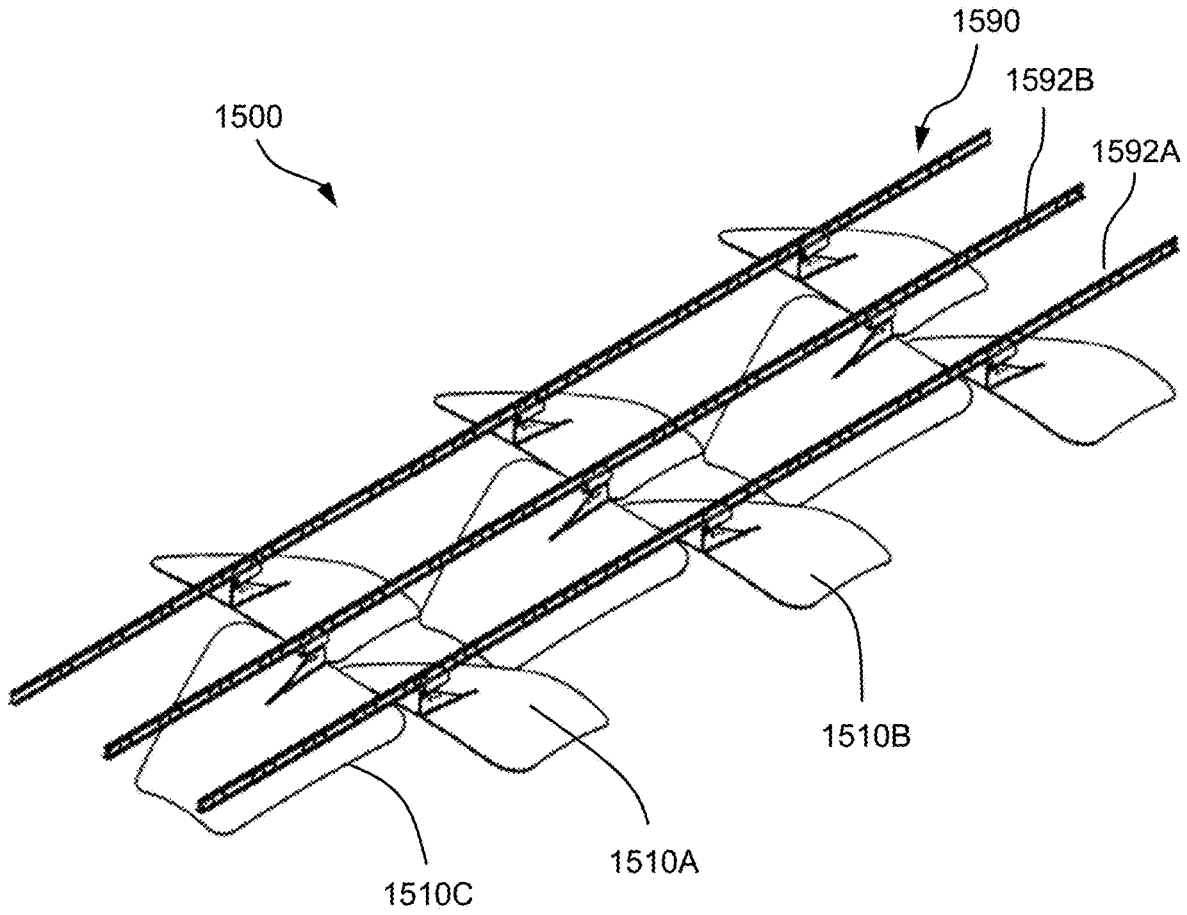
FIG. 15 is a schematic elevated perspective view of a ceiling system according to another embodiment of the disclosure.

FIG. 15 shows another such ceiling system. Ceiling system 1500 includes a ceiling grid 1590 having a first frame element 1592A and a second frame element 1592B. Ceiling system 1500 also includes a plurality of ceiling panels attached to the frame elements and disposed in opposing directions. For example, ceiling system 1500 includes a first column of ceiling panels attached to first frame element 1592A and extending in a first direction, where the first column includes first ceiling panel 1510A and second ceiling panel 1510B. Ceiling system 1500 also includes a second column of ceiling panels attached to second frame element 1592B, including third ceiling panel 1510C, that extend in a second direction and opposing direction.

As can be seen by comparing FIGS. 14A and 14B with 15, the spacing between the framing elements and associated columns of ceiling panels can be modified based on the spacing of the ceiling panels along the lengths of the framing elements in view of the tapered shape of the ceiling panels in certain embodiments. For example, as shown in FIG. 14B, ceiling panels extending in opposing directions may cross one another as they extend from the ceiling grid. The spacing between the grid elements may be limited by the width of the ceiling panels where they cross one another. For example, if the ceiling panels cross at their widest point, the spacing between grid elements may be as wide as the ceiling panels to prevent interference between the ceiling panels. On the other hand, in some embodiments where the ceiling panels are tapered, they are spaced along the grid elements such that they cross at a narrower section toward the tapered end. Accordingly, the ceiling panels in separate columns may be positioned more closely and the grid elements may also be spaced more closely.

In certain embodiments of the ceiling system as otherwise described herein, the third ceiling panel is disposed at a different angle from the second ceiling panel. For example, as shown in FIGS. 12A, third ceiling panel 1210C is disposed at a different angle from second ceiling panel 1210B. Further, in some embodiments, all of the ceiling panels attached to the first frame element are disposed at a first angle while all of the ceiling panels attached to the second frame element are disposed at a second angle that is different from the first angle. For example, in some embodiments, the angle of the ceiling panels alternate between columns or rows of the ceiling panels.

Figure 16A:
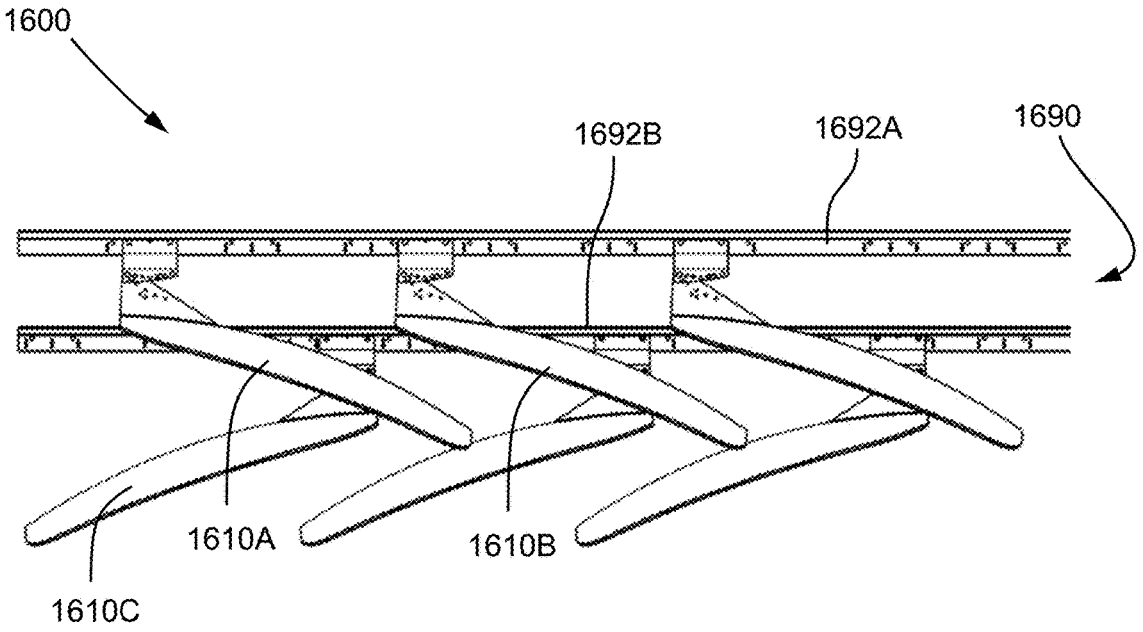
FIG. 16A is a schematic side view of a ceiling system according to another embodiment of the disclosure.
Figure 16B:
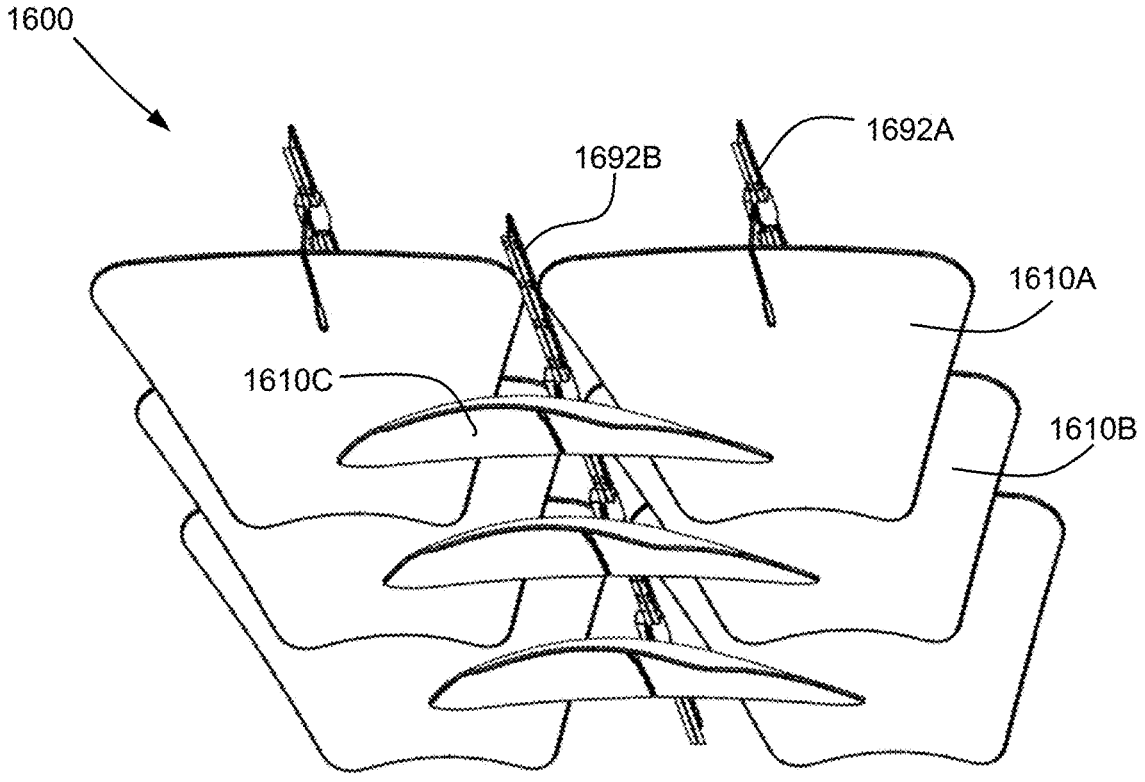
FIG. 16B is a schematic lower perspective view of the ceiling system according to FIG. 16A.

In certain embodiments of the ceiling system as otherwise described herein, the first frame element is disposed at a first elevation and the second frame element is disposed at a second elevation. For example, in some embodiments, the ceiling grid includes a first group of frame elements disposed in a first plane at a first elevation and a second group of frame elements disposed in a second plane at a second elevation. Accordingly, the ceiling panels in such an embodiment can overlap significantly. For example, such an embodiment is shown in FIGS. 16A and 16B, where FIG. 16A is a side view of the ceiling system and FIG. 16B is a view from below the ceiling system. Ceiling system 1600 includes a ceiling grid 1690 having a first frame element 1692A and a second frame element 1692B that is disposed below first frame element 1692A. Ceiling system 1600 also includes a plurality of ceiling panels attached to the frame elements. For example, a first ceiling panel 1610A and a second ceiling panel 1610B are attached along the length of first frame element 1692A forming a column of ceiling panels along first frame element 1692A. Ceiling system 1600 also includes a column of ceiling panels attached to second frame element 1692B that includes a third ceiling panel 1610C. In view of the position of second frame element 1692B being below first frame element 1692A, the ceiling panels attached to second frame element 1692B are able to overlap about half the width of the ceiling panels attached to first frame element 1692A.

Figure 17:
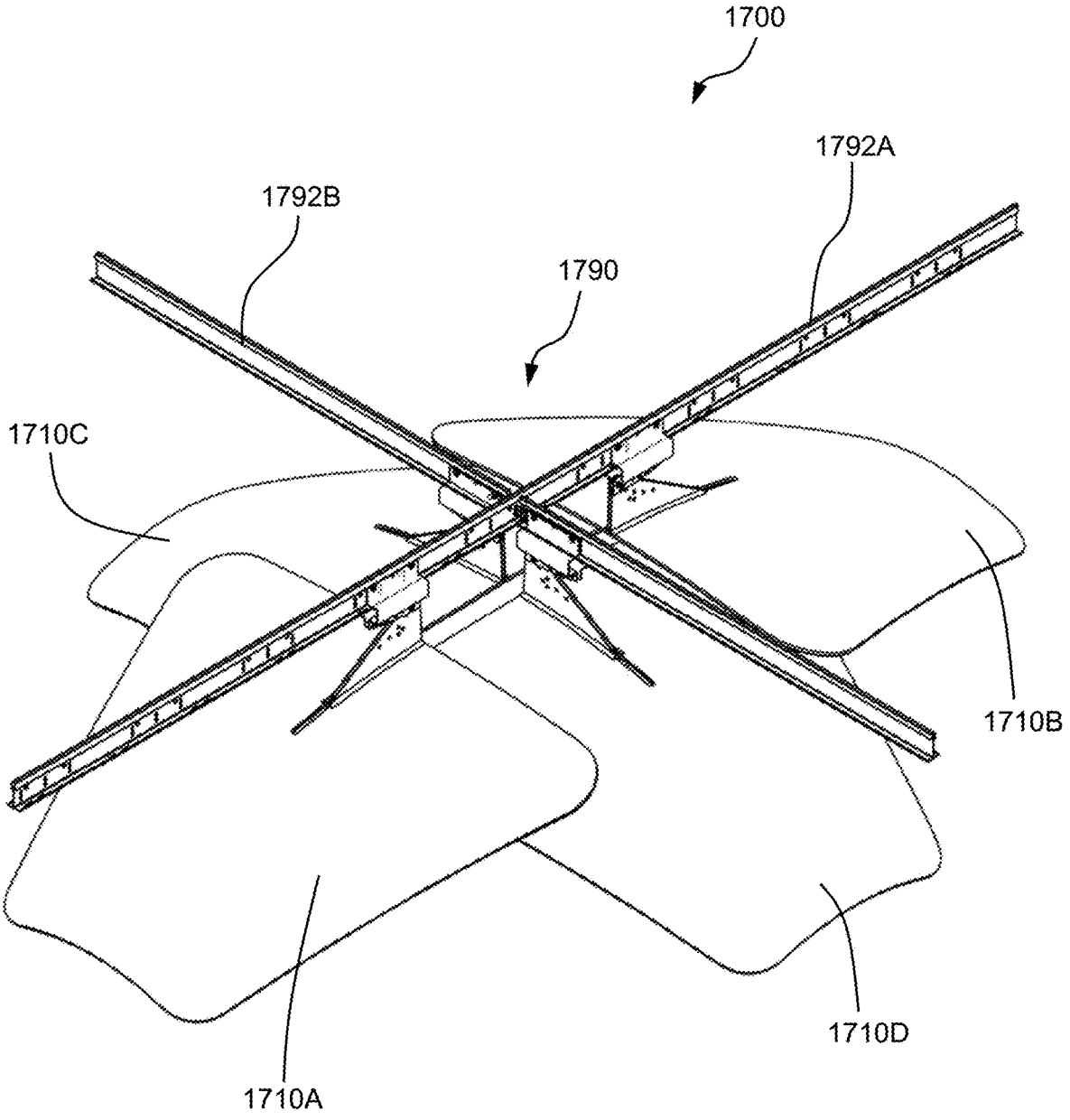
FIG. 17 is a schematic perspective view of a ceiling system according to another embodiment of the disclosure.

In certain embodiments of the ceiling system as otherwise described herein, the ceiling system further includes a second frame element that is perpendicular to the first frame element, and a third ceiling panel attached to the second frame element. Such a ceiling system is shown in FIG. 17. Ceiling system 1700 has a ceiling grid 1790 that includes a first frame element 1792A and a second frame element 1792B that is perpendicular to first frame element 1792A. Ceiling system 1700 also includes a first ceiling panel 1710A and a second ceiling panel 1710B that are attached to first frame element 1792A. Further, ceiling system 1700 also includes a third ceiling panel 1710C attached to the second frame element 1792B.

In certain embodiments of the ceiling system as otherwise described herein, the first and second ceiling panels extend in opposite directions. For example, in ceiling system 1700, first ceiling panel 1710A and second ceiling panel 1710B extend in opposite directions.

In certain embodiments of the ceiling system as otherwise described herein, the ceiling system further includes a fourth ceiling panel attached to the second frame element. Further, the first, second, third and fourth ceiling panels extend away from a joint between the first frame element and the second frame element. For example, ceiling system 1700 also includes a fourth ceiling panel 1710D attached to the second frame element 1792B. Similar to the first and second ceiling panels, third ceiling panel 1710C and fourth ceiling panel 1710D extend in opposite directions along second frame element 1792B. Moreover, all four of the ceiling panels 1710A, 1710B, 1710C and 1710D extend outward from the joint between first frame element 1792A and second frame element 1792B. Accordingly, the four ceiling panels 1710A, 1710B, 1710C and 1710D create a formation of ceiling panels on the ceiling grid 1790. Other formations of the ceiling panels are also possible by coordinating the angles and directions of the ceiling panels with respect to the ceiling grid.

Various embodiments of the disclosure are provided by the following enumerated embodiments, which can be combined in any number and in any combination that is not logically or technically inconsistent.

Embodiment 1. A ceiling panel comprising:

a panel body including an upper surface, a lower surface, a first end, a second end, a first lateral side, and a second lateral side; and a bracket extending upward from the upper surface of the panel body and offset from a center of gravity of the panel body toward the first end, the bracket including an upper fastener configured to attach the ceiling panel to a frame element of a ceiling grid, wherein an angle of the panel body is adjustable with respect to the attachment of the upper fastener of the bracket.

Embodiment 2. The ceiling panel according to Embodiment 1, wherein the angle of the panel body is adjustable about an axis extending in the lateral direction.

Embodiment 3. The ceiling panel according to Embodiment 1 or Embodiment 2, wherein the panel body is curved.

Embodiment 4. The ceiling panel according to any of Embodiments 1 to 3, wherein the lower surface of the panel body is concave.

Embodiment 5. The ceiling panel according to any of Embodiments 1 to 3, wherein the lower surface of the panel body is convex.

Embodiment 6. The ceiling panel according to any of Embodiments 1 to 5, wherein an outer edge of the panel body is rounded.

Embodiment 7. The ceiling panel according to any of Embodiments 1 to 6, wherein a width of the panel body tapers along a longitudinal direction that extends between the first end and second end.

Embodiment 8. The ceiling panel according to any of Embodiments 1 to 7, wherein the entire lower surface is unencumbered.

Embodiment 9. The ceiling panel according to any of Embodiments 1 to 8, wherein the area of the upper surface that surrounds the bracket is unencumbered.

Embodiment 10. The ceiling panel according to any of Embodiments 1 to 9, wherein a perimeter of the panel body along the first lateral side, second end, and second lateral side is free and unattached.

Embodiment 11. The ceiling panel according to any of Embodiments 1 to 10, wherein the panel body has a substantially uniform thickness.

Embodiment 12. The ceiling panel according to any of Embodiments 1 to 11, wherein the panel body is formed of a single material.

Embodiment 13. The ceiling panel according to any of Embodiments 1 to 12, wherein the panel body is formed of sheet metal.

Embodiment 14. The ceiling panel according to any of Embodiments 1 to 11, wherein the panel body is formed of a laminate.

Embodiment 15. The ceiling panel according to any of Embodiments 1 to 11, wherein the panel body includes a frame formed by a first material, and wherein the lower surface of the panel body is formed by a second material.

Embodiment 16. The ceiling panel according to any of Embodiments 1 to 15, wherein the lower surface of the panel body is covered by a coating.

Embodiment 17. The ceiling panel according to any of Embodiments 1 to 15, wherein the lower surface of the panel body is covered by an overlay.

Embodiment 18. The ceiling panel according to any of Embodiments 1 to 17, wherein at least a portion of the panel body is transparent.

Embodiment 19. The ceiling panel according to Embodiment 18, wherein the panel body forms a diffuser.

Embodiment 20. The ceiling panel according to any of Embodiments 1 to 19, wherein the upper fastener of the bracket includes a support flange configured to hook over a horizontal flange of the frame element of the ceiling grid.

Embodiment 21. The ceiling panel according to any of Embodiments 1 to 20, wherein the upper fastener of the bracket includes an upper web plate configured to connect to a vertical web of the frame element of the ceiling grid.

Embodiment 22. The ceiling panel according to any of Embodiments 1 to 21, wherein the upper fastener of the bracket includes a channel configured to surround a portion of the frame element of the ceiling grid.

Embodiment 23. The ceiling panel according to any of Embodiments 1 to 22, wherein the panel body has a length from the first end to the second end that is at least 6 inches, e.g., at least 12 inches, e.g., at least 18 inches.

Embodiment 24. The ceiling panel according to any of Embodiments 1 to 23, wherein the panel body has a length from the first end to the second end that is no more than 120 inches, e.g., no more than 60 inches, e.g., no more than 48 inches.

Embodiment 25. The ceiling panel according to any of Embodiments 1 to 24, wherein the panel body has a width from the first lateral side to the second lateral side that is at least 6 inches, e.g., at least 12 inches, e.g., at least 18 inches.

Embodiment 26. The ceiling panel according to any of Embodiments 1 to 25, wherein the panel body has a width from the first lateral side to the second lateral side that is no more than 120 inches, e.g., no more than 60 inches, e.g., no more than 48 inches.

Embodiment 27. The ceiling panel according to any of Embodiments 1 to 26, wherein the panel body has a thickness of no more than 25 mm, e.g., 10 mm, e.g., no more than 5 mm, e.g., no more than 2 mm.

Embodiment 28. The ceiling panel according to any of Embodiments 1 to 27, wherein the bracket further comprises a lower fastener that attaches to the upper fastener.

Embodiment 29. The ceiling panel according to Embodiment 28, wherein the attachment between the upper fastener and lower fastener is adjustable and provides the adjustability of the angle of the panel body.

Embodiment 30. The ceiling panel according to Embodiment 29, wherein at least one of the upper fastener and the lower fastener includes a plurality of openings for selectable connection with the other of the upper fastener and lower fastener.

Embodiment 31. The ceiling panel according to any of Embodiments 28 to 30, wherein the lower fastener includes a fin that extends upward from the upper surface of the panel body.

Embodiment 32. The ceiling panel according to any of Embodiment to 31, wherein the upper fastener includes a lower web plate that attaches to the fin of the lower fastener.

Embodiment 33. The ceiling panel according to any of Embodiments 28 to 32, wherein the lower fastener is integrally formed with the panel body in a single piece.

Embodiment 34. A method of forming a ceiling panel according to any of Embodiments 28 to 33, the method comprising:

forming the panel body;

forming the fin of the lower fastener of the bracket on the upper surface of the panel body; and attaching the upper fastener of the bracket to the fin of the lower fastener of the bracket.

Embodiment 35. The method according to Embodiment 34, wherein the panel body and the fin are formed from a single sheet of material.

Embodiment 36. The method according to Embodiment 35, wherein forming the fin includes bending the single sheet of material along a first crease to form a first wall of the fin and along a second crease to form a second wall of the fin.

Embodiment 37. The method according to Embodiment 36, wherein forming the fin includes bringing the first crease and the second crease together such that the lower surface of the panel body curves and the first wall of the fin is adjacent to the second wall of the fin.

Embodiment 38. A ceiling system comprising:

a ceiling grid formed by a plurality of frame elements including a first frame element;

a first ceiling panel according to any of Embodiments 1 to 33 attached to the first frame element; and a second ceiling panel according to any of Embodiments 1 to 33 attached to the first frame element.

Embodiment 39. The ceiling system according to Embodiment 38, wherein the first ceiling panel is attached to the ceiling grid only by an attachment of the bracket of the first ceiling panel to the first frame element.

Embodiment 40. The ceiling system according to Embodiment 38 or Embodiment 39, wherein an outer edge of the panel body of the first ceiling panel is free.

Embodiment 41. The ceiling system according to any of Embodiments 38 to 40, wherein a second end of the first ceiling panel overlaps the first end of the second ceiling panel.

Embodiment 42. The ceiling system according to any of Embodiments 38 to 41, wherein the first ceiling panel and second ceiling panel are both attached to the first frame element at the same angle.

Embodiment 43. The ceiling system according to any of Embodiments 38 to 42, wherein the first ceiling panel is attached to the first frame element at a first angle and the second ceiling panel is attached to the first frame element at a second angle that is different from the first angle.

Embodiment 44. The ceiling system according to any of Embodiments 38 to 43, further comprising:

a second frame element that is parallel to the first frame element, and a third ceiling panel attached to the second frame element.

Embodiment 45. The ceiling system according to Embodiment 44, wherein the third ceiling panel is aligned with the first ceiling panel along the length of the frame elements.

Embodiment 46. The ceiling system according to Embodiment 44, wherein the third ceiling panel is offset between the first ceiling panel and the second ceiling panel along the length of the frame elements.

Embodiment 47. The ceiling system according to any of Embodiments 44 to 46, wherein the first and second ceiling panels project in a first direction and the third ceiling panel projects in a second direction that is opposite the first direction.

Embodiment 48. The ceiling system according to any of Embodiments 38 to 43, further comprising a second frame element that is perpendicular to the first frame element, and a third ceiling panel attached to the second frame element.

Embodiment 49. The ceiling system according to Embodiment 48, wherein the first and second ceiling panels extend in opposite directions.

Embodiment 50. The ceiling system according to Embodiment 49, further comprising a fourth ceiling panel attached to the second frame element, wherein the first, second, third and fourth ceiling panels extend away from a joint between the first frame element and the second frame element.

Embodiment 51. The ceiling system according to any of Embodiments 43 to 50, the third ceiling panel is disposed at a different angle from the second ceiling panel.

Embodiment 52. The ceiling system according to any of Embodiments 43 to 51, wherein the first frame element is disposed at a first elevation and the second frame element is disposed at a second elevation.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A ceiling system comprising:

a ceiling grid formed by a plurality of frame elements including a first frame element, the first frame element being a beam comprising a vertical web having a bottom end, and at least one horizontal flange extending from the bottom end of the vertical web;

a first ceiling panel and a second ceiling panel each affixed to the first frame element, each comprising:

a panel body including an upper surface, a lower surface, a first end, a second end, a first lateral side, and a second lateral side; and a bracket extending upward from the upper surface of the panel body and offset from a center of gravity of the panel body toward the first end, the bracket including an upper fastener comprising a first support flange resting on one of the at least one horizontal flanges of the first frame element; and a first upper web plate extending upward from the first support flange and disposed against and attached to a side of the vertical web of the first frame element, and wherein in each of the first ceiling panel and second ceiling panel, an angle of the panel body is adjustable with respect to the attachment of the upper fastener of the bracket, and a perimeter of the panel body along the first lateral side, second end, and second lateral side is free and unattached, wherein the bracket further comprises a lower fastener that attaches to the upper fastener and to the panel body, and wherein an attachment between the upper fastener and lower fastener is adjustable and provides the adjustability of the angle of the panel body.

2. The ceiling system according to claim 1, wherein in each of the first ceiling panel and second ceiling panel, the angle of the panel body is adjustable about an axis extending in a lateral direction.

3. The ceiling system according to claim 1, wherein in each of the first ceiling panel and second ceiling panel, the panel body is curved.

4. The ceiling system according to claim 3, wherein in each of the first ceiling panel and the second ceiling panel the lower surface of the panel body is concave.

5. The ceiling system according to claim 1, wherein in each of the first ceiling panel and second ceiling panel, a width of the panel body tapers along a longitudinal direction that extends between the first end and the second end.

6. The ceiling system according to claim 1, wherein an entirety of the lower surface is unencumbered.

7. The ceiling system according to claim 1, wherein in each of the first ceiling panel and second ceiling panel, an area of the upper surface that surrounds the bracket is unencumbered.

8. The ceiling system according to claim 1, wherein the upper fastener of the bracket includes a channel configured to surround a portion of the first frame element of the ceiling grid.

9. The ceiling system according to claim 1, wherein at least one of the upper fastener and the lower fastener includes a plurality of openings for selectable connection with the other of the upper fastener and lower fastener.

10. The ceiling system according to claim 1, wherein the lower fastener is integrally formed with the panel body in a single piece.

11. The ceiling system according to claim 1, wherein an outer edge of the panel body of the first ceiling panel is free.

12. The ceiling system of claim 1, wherein the at least one horizontal flange of the first frame element comprises two opposing horizontal flanges and extending from the bottom end of the vertical web, and wherein in each of the first ceiling panel and second ceiling panel the upper fastener of the bracket further comprises a second support flange resting on the horizontal flange of the first frame element opposing the horizontal flange on which the first support flange rests; and a second upper web plate extending upward from the second support flange and disposed against and attached to a second side of the vertical web of the first frame element.

13. A ceiling system comprising:

a ceiling grid formed by a plurality of frame elements including a first frame element, the first frame element being a beam comprising a vertical web having a bottom end, and at least one horizontal flange extending from the bottom end of the vertical web;

a first ceiling panel and a second ceiling panel each affixed to the first frame element, each comprising:

a panel body including an upper surface, a lower surface, a first end, a second end, a first lateral side, and a second lateral side; and a bracket extending upward from the upper surface of the panel body and offset from a center of gravity of the panel body toward the first end, the bracket including an upper fastener comprising a first support flange resting on one of the at least one horizontal flanges of the first frame element; and a first upper web plate extending upward from the first support flange and disposed against and attached to a side of the vertical web of the first frame element, and wherein in each of the first ceiling panel and second ceiling panel, an angle of the panel body is adjustable with respect to the attachment of the upper fastener of the bracket, and a perimeter of the panel body along the first lateral side, second end, and second lateral side is free and unattached, wherein the bracket further comprises a lower fastener that attaches to the upper fastener and to the panel body, the lower fastener including a fin that extends upward from the upper surface of the panel body.

14. The ceiling system according to claim 13, wherein the upper fastener includes a lower web plate that attaches to the fin of the lower fastener.

15. The ceiling system according to claim 13, wherein in each of the first ceiling panel and the second panel, the fin has a first wall formed from a first folded section of a single sheet of material and a second wall formed from an opposing second folded section of the single sheet of material.

16. The ceiling system according to claim 13, wherein the lower fastener is integrally formed with the panel body in a single piece.

17. A ceiling system comprising:

a ceiling grid formed by a plurality of frame elements including a first frame element, the first frame element being a beam comprising a vertical web having a bottom end, and at least one horizontal flange extending from the bottom end of the vertical web;

a first ceiling panel and a second ceiling panel each affixed to the first frame element, each comprising:

a panel body including an upper surface, a lower surface, a first end, a second end, a first lateral side, and a second lateral side; and a bracket extending upward from the upper surface of the panel body and offset from a center of gravity of the panel body toward the first end, the bracket including an upper fastener comprising a first support flange resting on one of the at least one horizontal flanges of the first frame element; and a first upper web plate extending upward from the first support flange and disposed against and attached to a side of the vertical web of the first frame element, and wherein in each of the first ceiling panel and second ceiling panel, an angle of the panel body is adjustable with respect to the attachment of the upper fastener of the bracket, and a perimeter of the panel body along the first lateral side, second end, and second lateral side is free and unattached, wherein a second end of the first ceiling panel overlaps the first end of the second ceiling panel.

18. A method of forming a ceiling panel, the ceiling panel comprising a panel body including an upper surface, a lower surface, a first end, a second end, a first lateral side, and a second lateral side; and a bracket extending upward from the upper surface of the panel body and offset from a center of gravity of the panel body toward the first end, the bracket including an upper fastener configured to attach the ceiling panel to a frame element of a ceiling grid and a lower fastener that attaches to the upper fastener and to the panel body, wherein an angle of the panel body is adjustable with respect to the attachment of the upper fastener of the bracket, and a perimeter of the panel body along the first lateral side, second end, and second lateral side is free and unattached, the method comprising:

forming the panel body;

forming a fin of the lower fastener of the bracket on the upper surface of the panel body; and attaching the upper fastener of the bracket to the fin of the lower fastener of the bracket.

19. The method of claim 18, wherein forming the fin includes bending a single sheet of material along a first crease to form a first wall of the fin and along a second crease to form a second wall of the fin.

20. A ceiling system comprising:

a ceiling grid formed by a plurality of frame elements including a first frame element, the first frame element being a beam comprising a vertical web having a bottom end, and at least one horizontal flange extending from the bottom end of the vertical web;

a first ceiling panel and a second ceiling panel each affixed to the first frame element, each comprising:

a panel body including an upper surface, a lower surface, a first end, a second end, a first lateral side, and a second lateral side; and a bracket extending upward from the upper surface of the panel body and offset from a center of gravity of the panel body toward the first end, the bracket including an upper fastener comprising a first support flange resting on one of the at least one horizontal flanges of the first frame element; and a first upper web plate extending upward from the first support flange and disposed against and attached to a side of the vertical web of the first frame element, and wherein in each of the first ceiling panel and second ceiling panel, an angle of the panel body is adjustable with respect to the attachment of the upper fastener of the bracket, and a perimeter of the panel body along the first lateral side, second end, and second lateral side is free and unattached, wherein in each of the first ceiling panel and second ceiling panel, the angle of the panel body is adjustable about an axis extending in a lateral direction, and is not adjustable about an axis extending perpendicular to the lateral direction.

* * * * *